US008026868B2

(12) United States Patent
Bae et al.

(10) Patent No.: US 8,026,868 B2
(45) Date of Patent: Sep. 27, 2011

(54) PLASMA DISPLAY APPARATUS AND METHOD OF DRIVING THE SAME

(75) Inventors: Jongwoon Bae, Gumi-si (KR); Kirack Park, Gyeongsangbuk-do (KR); Seonghwan Ryu, Gumi-si (KR); Yoonjoo Cho, Seoul (KR); Dooyong Hwang, Yongin-si (KR)

(73) Assignee: LG Electronics Inc., Seoul (KR)

( * ) Notice: Subject to any disclaimer, the term of this patent is extended or adjusted under 35 U.S.C. 154(b) by 1428 days.

(21) Appl. No.: 11/512,154

(22) Filed: Aug. 30, 2006

(65) Prior Publication Data

US 2007/0080894 A1 Apr. 12, 2007

(30) Foreign Application Priority Data

Oct. 7, 2005 (KR) ..... 10-2005-0094569

(51) Int. Cl.
*G09G 3/28* (2006.01)

(52) U.S. Cl. ..... 345/60; 345/55; 345/61; 345/62; 345/63; 345/213; 345/214

(58) Field of Classification Search ..... 345/60–63, 345/55, 213–214
See application file for complete search history.

(56) References Cited

U.S. PATENT DOCUMENTS

| | | | | |
|---|---|---|---|---|
| 5,739,641 | A * | 4/1998 | Nakamura et al. | 315/169.1 |
| 6,636,187 | B2 * | 10/2003 | Tajima et al. | 345/55 |
| 2004/0227774 | A1 * | 11/2004 | Matsumoto | 345/690 |
| 2005/0184929 | A1 | 8/2005 | Lee | 345/60 |
| 2005/0285817 | A1 | 12/2005 | Yoon et al. | 345/63 |

FOREIGN PATENT DOCUMENTS

| | | | |
|---|---|---|---|
| EP | 0 945 844 | | 9/1999 |
| EP | 1 622 117 | | 2/2006 |
| EP | 1 635 316 | | 3/2006 |
| EP | 1 643 479 | | 4/2006 |
| EP | 1 657 703 | | 5/2006 |
| JP | 10-187093 | * | 7/1998 |
| JP | 10187093 | | 7/1998 |

* cited by examiner

*Primary Examiner* — Richard Hjerpe
*Assistant Examiner* — Leonid Shapiro
(74) *Attorney, Agent, or Firm* — Ked & Associates LLP

(57) ABSTRACT

A plasma display apparatus and a method of driving the same are disclosed. The plasma display apparatus includes a plurality of scan electrodes, a plurality of data electrodes, a scan driver and a data driver. The scan driver scans the plurality of scan electrodes during an address period in one scanning type of a plurality of scanning types having different scanning orders. Further, the scan driver supplies a scan signal, of which the duration of a voltage rising period is different from the duration of a voltage falling period, to the scan electrodes when scanning the scan electrodes. The data driver supplies a data signal to the data electrodes depending on the scanning type selected from the plurality of scanning types.

27 Claims, 17 Drawing Sheets

PLASMA DISPLAY APPARATUS AND METHOD OF DRIVING THE SAME

This Nonprovisional application claims priority under 35 U.S.C. §119(a) on Patent Application No. 10-2005-0094569 filed in Korea on Oct. 7, 2006 the entire contents of which are hereby incorporated by reference.

BACKGROUND OF THE INVENTION

1. Field of the Invention

This document relates to a display apparatus, and more particularly, to a plasma display apparatus and a method of driving the same.

2. Description of the Background Art

A plasma display panel comprises a front panel, a rear panel and barrier ribs formed between the front panel and the rear panel. The barrier ribs forms unit discharge cell or discharge cells. Each of discharge cells is filled with a main discharge gas such as neon (Ne), helium (He) and a mixture of Ne and He, and an inert gas containing a small amount of xenon (Xe). When it is discharged by a high frequency voltage, the inert gas generates vacuum ultra-violet rays, which thereby cause phosphors formed between the barrier ribs to emit light, thus displaying an image. Since the plasma display panel can be manufactured to be thin and light, it has attracted attention as a next generation display device.

A plurality of electrodes, for example, a scan electrode, a sustain electrode and a data electrode are formed in the plasma display panel. A driver supplies a predetermined driving voltage to the plurality of electrodes to generate a discharge such that an image is displayed. The driver for supplying the predetermined driving voltage to the plurality of electrodes of the plasma display panel is connected to the plurality of electrodes in the form of a driver integrated circuit (IC).

For example, a data driver IC is connected to the data electrode of the plasma display panel, and a scan driver IC is connected to the scan electrode of the plasma display panel.

When driving the plasma display panel, a displacement current flows in these driver ICs. A magnitude of the displacement current varies by various factors.

For example, a displacement current flowing in the data driver IC may vary in accordance with equivalence capacitance of the plasma display panel and the number of switching operation times of the data driver IC. More specifically, the displacement current flowing in the data driver IC is proportional to the equivalence capacitance of the plasma display panel and the number of switching operation times of the data driver IC.

In particular, when image data is a specific pattern where logical values 1 and 0 are repeatedly input, the displacement current flowing in the data driver IC excessively increases such that the data driver IC is electrically damaged.

SUMMARY OF THE INVENTION

Accordingly, an object of the present invention is to solve at least the problems and disadvantages of the related art.

In an aspect, there is provided a plasma display apparatus comprising a plurality of scan electrodes, a plurality of data electrodes intersecting with the plurality of scan electrodes, a scan driver for scanning the plurality of scan electrodes during an address period in one scanning type of a plurality of scanning types having different scanning orders, and for supplying a scan signal, of which the duration of a voltage rising period is different from the duration of a voltage falling period, to the scan electrodes when scanning the scan electrodes, and a data driver for supplying a data signal to the data electrodes depending on the scanning type selected from the plurality of scanning types.

Embodiments of the present invention provide a plasma display apparatus and a method of driving the same capable of preventing an electrical damage of a driver integrated circuit by reducing an excessive displacement current.

The embodiments of the present invention provide a plasma display apparatus and a method of driving the same capable of improving accuracy of an address discharge and a jitter characteristic by reducing a noise of a driving signal.

BRIEF DESCRIPTION OF THE DRAWINGS

The embodiment of the invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

A plasma display apparatus according to an embodiment of the present invention comprises a plurality of scan electrodes, a plurality of data electrodes intersecting with the plurality of scan electrodes, a scan driver for scanning the plurality of scan electrodes during an address period in one scanning type of a plurality of scanning types having different scanning orders, and for supplying a scan signal, of which the duration of a voltage rising period is different from the duration of a voltage falling period, to the scan electrodes when scanning the scan electrodes, and a data driver for supplying a data signal to the data electrodes depending on the scanning type selected from the plurality of scanning types.

A plasma display apparatus according to the embodiment of the present invention comprises a plurality of scan electrodes, a plurality of data electrodes intersecting with the plurality of scan electrodes, a scan driver for scanning the plurality of scan electrodes during an address period in one scanning type of a plurality of scanning types having different scanning orders, and for supplying a scan signal to the scan electrodes when scanning the scan electrodes, at least one of a voltage rising period or a voltage falling period of the scan signal being equal to or more than 50 ns, and a data driver for supplying a data signal to the data electrodes depending on the scanning type selected from the plurality of scanning types.

A method of driving a plasma display apparatus comprising a scan electrode and a data electrode intersecting with the scan electrode according to the embodiment of the present invention, comprises scanning the scan electrode during an address period in one scanning type of a plurality of scanning types having different scanning orders, and supplying a scan signal, of which the duration of a voltage rising period is different from the duration of a voltage falling period, to the scan electrode when scanning the scan electrode, and supplying a data signal to the data electrodes depending on the scanning type selected from the plurality of scanning types.

Hereinafter, exemplary embodiments of the present invention will be described in detail with reference to the attached drawings.

Figure 1:
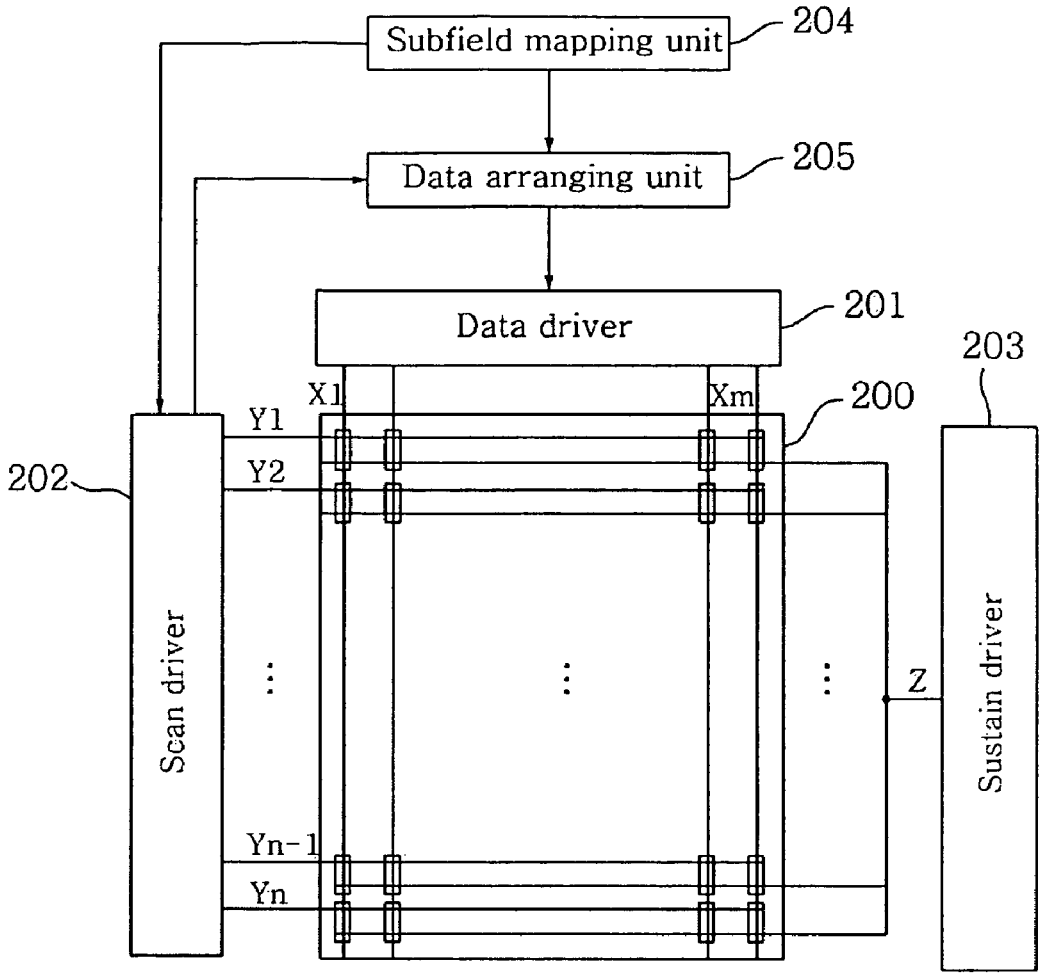
FIG. 1 illustrates a plasma display apparatus according to an embodiment of the present invention.

FIG. 1 illustrates a plasma display apparatus according to an embodiment of the present invention.

As illustrated in FIG. 1, a plasma display apparatus according to an embodiment of the present invention comprises a plasma display panel 200, a data driver 201, a scan driver 202, a sustain driver 203, a subfield mapping unit 204 and a data arranging unit 205.

The plasma display panel 200 comprises a front panel (not shown) and a rear panel (not shown) which are coalesced with each other at a given distance. In the plasma display panel 200, scan electrodes Y and sustain electrodes Z are formed in parallel, and data electrodes X are formed to intersect with the scan electrodes Y and the sustain electrodes Z. The structure of the plasma display panel 200 will be described in detail below, with reference to FIG. 2.

The data driver 201, the scan driver 202, the sustain driver 203 supply a driving signal to the data electrode X, the scan electrode Y and the sustain electrode Z, respectively such that an image is displayed on the plasma display apparatus.

Figure 2:
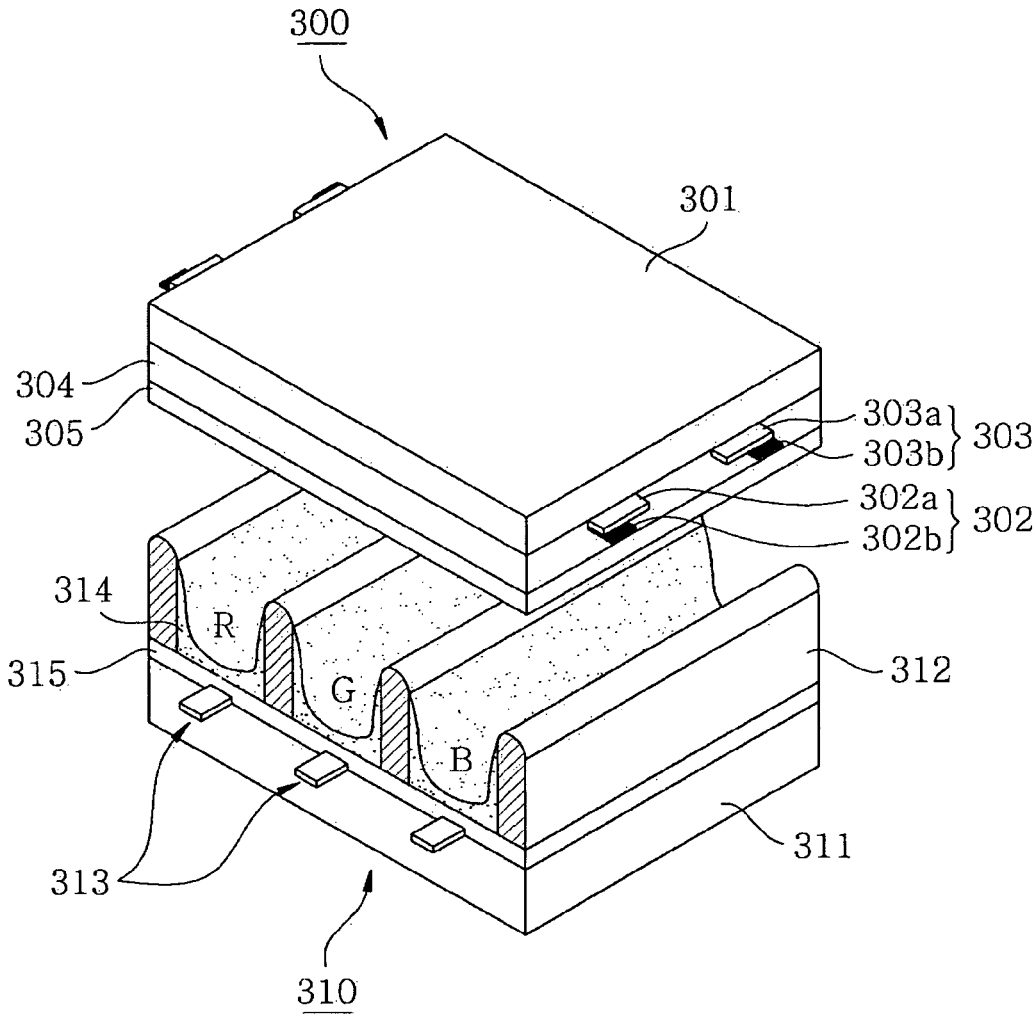
FIG. 2 illustrates the structure of a plasma display panel of the plasma display apparatus according to the embodiment of the present invention.

FIG. 2 illustrates the structure of a plasma display panel of the plasma display apparatus according to the embodiment of the present invention.

As illustrated in FIG. 2, the plasma display panel comprises a front panel 300 and a rear panel 310 which are coupled in parallel to oppose to each other at a given distance therebetween. The front panel 300 comprises a front substrate 301 which is a display surface. The rear panel 310 comprises a rear substrate 311 constituting a rear surface. A plurality of scan electrodes 302 and a plurality of sustain electrodes 303 are formed in pairs on the front substrate 301, on which an image is displayed, to form a plurality of maintenance electrode pairs. A plurality of address electrodes 313 are arranged on the rear substrate 311 to intersect with the plurality of maintenance electrode pairs.

The scan electrode 302 and the sustain electrode 303 each comprise transparent electrodes 302*a* and 303*a* made of transparent indium-tin-oxide (ITO) material and bus electrodes 302*b* and 303*b* made of a metal material. The scan electrode 302 and the sustain electrode 303 generate a mutual discharge therebetween in one discharge cell and maintain light emissions of discharge cells. The scan electrode 302 and the sustain electrode 303 each may consist of the transparent electrodes 302*a* and 303*a*. Further, the scan electrode 302 and the sustain electrode 303 each may consist of the bus electrodes 302*b* and 303*b*. The scan electrode 302 and the sustain electrode 303 are covered with one or more upper dielectric layers 304 to limit a discharge current and to provide insulation between the maintenance electrode pairs. A protective layer 305 with a deposit of MgO is formed on an upper surface of the upper dielectric layer 304 to facilitate discharge conditions.

A plurality of stripe-type (or well-type) barrier ribs 312 are formed in parallel on the rear substrate 111 of the rear panel 310 to form a plurality of discharge spaces (i.e., a plurality of discharge cells). The plurality of data electrodes 313 for performing an address discharge to generate vacuum ultraviolet rays are arranged in parallel to the barrier ribs 312. An upper surface of the rear substrate 111 is coated with Red (R), green (G) and blue (B) phosphors 314 for emitting visible light for an image display when an address discharge is performed. A lower dielectric layer 315 is formed between the data electrodes 313 and the phosphors 314 to protect the data electrodes 313.

The front panel 300 and the rear panel 310 are coalesced by a sealing process such that the plasma display panel is formed. A driver for driving the scan electrode 302, the sustain electrode 303 and the address electrode 313 is adhered to the plasma display panel such that a plasma display apparatus is completed.

A driving signal of the plasma display apparatus according to the embodiment of the present invention is described with reference to FIGS. 3 and 4.

Figure 3:
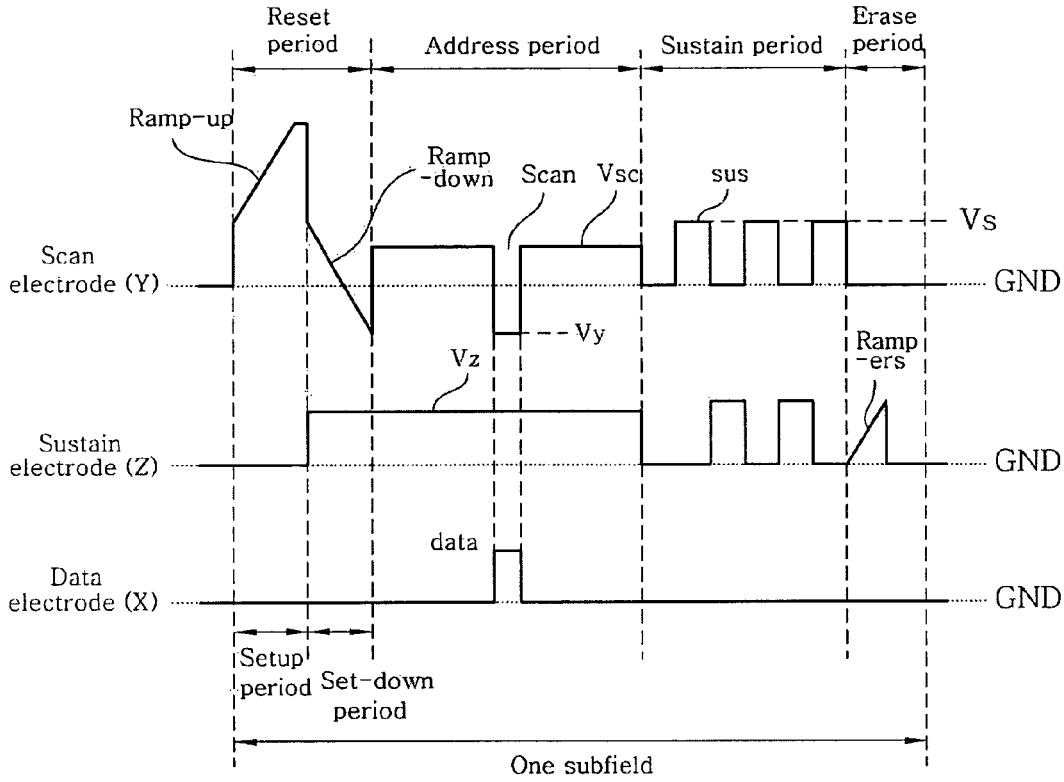
FIG. 3 illustrates an example of a driving method of the plasma display apparatus according to the embodiment of the present invention.

FIG. 3 illustrates an example of a driving method of the plasma display apparatus according to the embodiment of the present invention.

As illustrated in FIG. 3, the plasma display panel 200 is driven by dividing each of subfields into a reset period for initializing all cells, an address period for selecting cells to be discharged, a sustain period for discharge maintenance of the selected cells, and an erase period wall for erasing charges within the discharged cell.

The reset period is further divided into a setup period and a set-down period. The scan driver 202 of FIG. 1 supplies a rising signal (Ramp-up) to all scan electrodes Y during the setup period. The rising signal generates a weak dark discharge within the discharge cell of the whole screen. The weak dark discharge refers to a setup discharge. This setup discharge results in wall charges of a positive polarity being accumulated on the data electrodes X and the sustain electrodes Z, and wall charges of a negative polarity being accumulated on the scan electrodes Y.

The scan driver 202 supplies a falling signal (Ramp-down) which falls from a positive voltage lower than a peak voltage of the rising signal (Ramp-up) to a given voltage lower than a ground level voltage to the scan electrodes Y during the set-down period, thereby causing a weak erase discharge within the cells. Furthermore, the remaining wall charges are uniform inside the cells to the extent that the address discharge can be stably performed.

The scan driver 202 sequentially supplies a negative scan signal (Scan) to the scan electrodes Y during the address period. The data driver 201 supplies a positive data signal (data) synchronized with the scan signal (Scan) to the data electrodes X. As the voltage difference between the negative scan signal (Scan) and the positive data signal (data) is added to the wall voltage produced during the reset period, the address discharge is generated within the discharge cells to which the data signal is applied. The wall charges are formed inside the cells selected by performing the address discharge when a sustain voltage Vs is supplied such that a sustain discharge occurs.

The scan driver 202 scans the plurality of scan electrodes Y during the address period in one scanning type of a plurality of scanning types in which scanning order of the plurality of scan electrodes Y is different. In other words, a scan signal (Scan) of a negative scan voltage −Vy is supplied to the scan electrodes Y during the address period in scanning order of one scanning type selected from the plurality of scanning types. This will be described in detail later, with reference to FIG. 9.

Further, the scan driver 202 controls a voltage falling period and a voltage rising period of the scan signal (Scan). This will be described in detail later, with reference to FIGS. 5 through 8.

The scan driver 202 supplies a sustain signal (SUS) to the scan electrodes Y during the sustain period.

The sustain driver 203 supplies a bias voltage Vz to the sustain electrodes Z during the duration ranging from at least one of a supply period of the falling signal (Ramp-down) or the address period to prior to the sustain period such that an erroneous discharge does not occur between the sustain electrode Z and the scan electrode Y by reducing the voltage difference between the sustain electrode Z and the scan electrode Y.

The sustain driver 203 operates alternately with the scan driver 203 during the sustain period such that a sustain signal (SUS) is supplied to the sustain electrode Z. As the wall voltage within the cells selected by performing the address discharge is added to the sustain signal, a sustain discharge (i.e., a display discharge) is generated between the scan electrode Y and the sustain electrode Z whenever the sustain signal is applied. Finally, during the erase period, (i.e., after the sustain discharge is completed) an erase signal (Ramp-ers) having a small signal width and a low voltage level is supplied to the sustain electrodes Z to erase the remaining wall charges within all the cells.

The subfield mapping unit 204 performs subfield-mapping on image data input from the outside, for example, supplied from a half tone correction unit (not shown), and then outputs the subfield-mapping data.

The data arranging unit 205 rearranges the mapped data to correspond to each of the data electrode of the plasma display panel 200.

The data driver 201, under the control of a timing controller (not shown) , samples and latches the rearranged data, and then supplies the data to the data electrodes X. In particular, during the address period, the data driver 201 supplies the data to the data electrodes X corresponding to the scanning type of the scan electrode Y performed by the scan driver 202.

Figure 4:
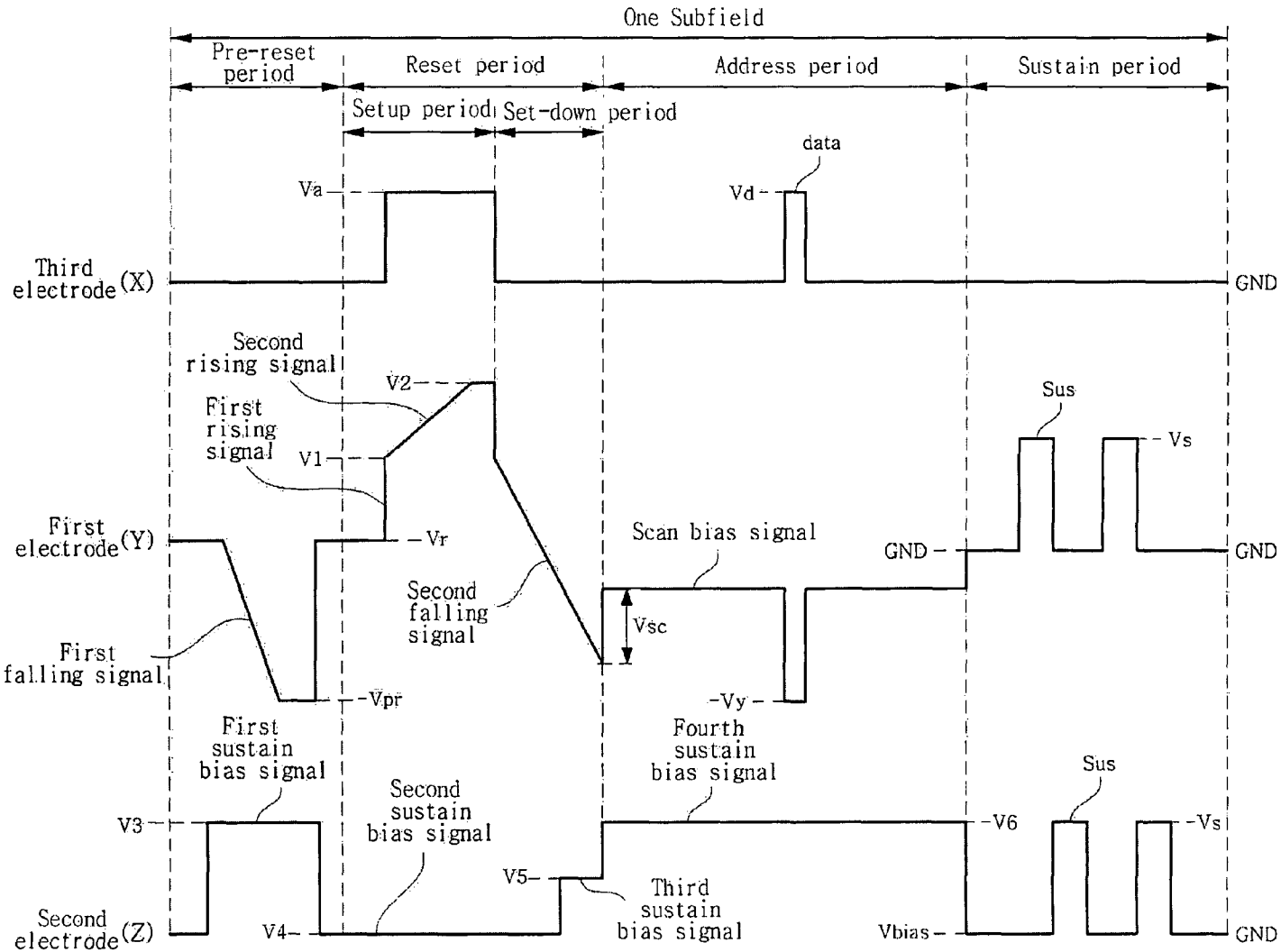
FIG. 4 illustrates another example of the driving method of the plasma display apparatus according to the embodiment of the present invention.

FIG. 4 illustrates another example of a driving method of the plasma display apparatus according to the embodiment of the present invention.

As illustrated in FIG. 4, since a subfield further includes a pre-reset period prior to a reset period, a maximum voltage of a second rising signal supplied during the reset period can be reduced.

During the pre-reset period prior to the reset period, a first falling signal is supplied to a first electrode Y. During the supply of the first falling signal to the first electrode Y, a first sustain bias signal of a polarity opposite a polarity of the first electrode Y is supplied to a second electrode Z.

The first falling signal supplied to the first electrode Y may gradually fall to a voltage −Vpr. In such a case, the first falling signal may gradually fall from a ground level voltage.

It is preferable that the first sustain bias signal is substantially maintained at a sustain bias voltage V3. The sustain bias voltage V3 may be substantially equal to a sustain voltage Vs of a sustain signal (SUS) supplied during a sustain period.

During the pre-reset period, the first falling signal is supplied to the first electrode Y. and the first sustain bias signal is supplied to the second electrode Z. This results in wall charges of a predetermined polarity being accumulated on the first electrode Y, and wall charges of a polarity opposite the predetermined polarity being accumulated on the second electrode Z.

Accordingly, a setup discharge with sufficient intensity can occur during the reset period such that initialization of the discharge cells is stably performed.

All subfields of a frame may comprise the above-described pre-reset period prior to the reset period.

A subfield with lowest-level weight in the subfields of the frame may comprise the pre-reset period before the reset period in consideration of sufficient driving time. Further, two or three subfields in the subfields of the frame may comprise the pre-reset period prior to the reset period.

Further, the above-described pre-reset period may be omitted in all subfields of the frame.

The reset period subsequent to the pre-reset period comprises a setup period and a set-down period. During the setup period, a rising signal of a polarity opposite the polarity of the first falling signal is supplied to the first electrode Y.

It is preferable that the rising signal comprises a first rising signal which abruptly rises to a voltage of about V1 and a second rising signal which gradually rises from the voltage of about V1 to a voltage of about V2. More preferably, the voltage V1 equals to a voltage Vsc, and the voltage V2 equals to a voltage Vsc+Vs.

It is preferable that a driver (not shown) supplies a second sustain bias signal having a voltage lower than the sustain bias voltage V3 of the first sustain bias signal to the second electrode Z.

It is preferable that the second sustain bias signal is substantially maintained at a second sustain bias voltage V4. The second sustain bias voltage V4 of the second sustain bias signal may equal to the ground level voltage GND.

It is preferable that a slope of the second rising signal is less than a slope of the first rising signal. As a result, quantity of light generated by a setup discharge decreases.

The driver supplies a positive polarity signal rising to a voltage Va to a third electrode X.

During the set-down period, the driver supplies a second falling signal subsequent to the supply of the rising signal to the first electrode Y. A polarity of the second falling signal is opposite to a polarity of the rising signal.

It is preferable that the second falling signal gradually falls from the voltage V2. Further, it is preferable that a voltage magnitude of a scan bias signal equals to a voltage Vsc.

The driver supplies a third sustain bias signal to the second electrode Z during a portion of the duration of the supply of the second falling signal to the first electrode Y. The third sustain bias signal is maintained at a sustain bias voltage V5. The sustain bias voltage V5 of the third sustain bias signal is substantially equal to one half of the sustain voltage Vs.

During the address period, a scan bias signal of a negative scan voltage −Vy is sequentially supplied to the first electrode Y and, at the same time, a positive data voltage synchronized with the scan bias signal is supplied to the third electrodes X.

It is preferable that a magnitude of the voltage −Vpr of the first falling signal is three times a magnitude of the negative scan voltage of the scan bias signal. In other words, a relationship of $Vy<Vpr\leqq 3\,Vy$ is satisfied.

The driver scans the plurality of first electrodes Y during the address period in one scanning type of a plurality of scanning types having different scanning orders. A fourth sustain bias signal of a sustain bias voltage V6 is supplied to the second electrode Z. It is preferable that the sustain bias voltage V6 of the fourth sustain bias signal is substantially equal to the sustain voltage Vs.

During the sustain period, the sustain signal (SUS) of the sustain voltage Vs is alternately supplied to the first electrode Y and the sustain electrode Z.

Figure 5:
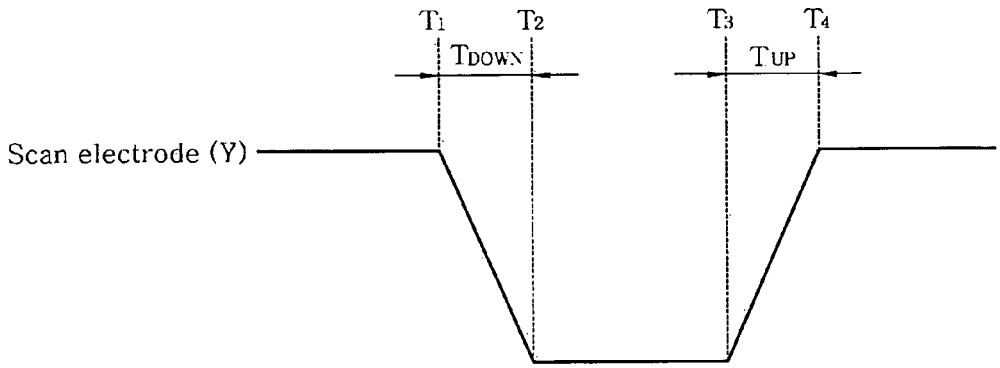
FIG. 5 illustrates a scan signal supplied during an address period in the driving method of the plasma display apparatus according to the embodiment of the present invention.

FIG. 5 illustrates a scan signal supplied during an address period in the driving method of the plasma display apparatus according to the embodiment of the present invention.

As illustrated in FIG. 5, the scan signal supplied during the address period by the scan driver 202 of FIG. 1 has a voltage falling period $T_{DOWN}$ and a voltage rising period $T_{UP}$. The duration of the voltage falling period $T_{DOWN}$ ranges from a time point T1 to a time point T2, and the duration of the voltage rising period $T_{UP}$ ranges from a time point T3 to a time point T4. Since a real waveform of the scan signal is not ideal, the duration of the voltage falling period $T_{DOWN}$ ranges from a supply start time point to a time point reaching about 90% of a voltage of the scan signal. The duration of the voltage rising period $T_{UP}$ ranges from a rising start time point to a time point reaching about 10% of a voltage of the scan signal.

The scan driver 202 supplies a scan signal, where the duration of the voltage rising period $T_{UP}$ is different from the duration of the voltage falling period $T_{DOWN}$, to the scan electrode Y. The duration of voltage rising period $T_{UP}$ and the duration of the voltage falling period $T_{DOWN}$ of the scan signal in at least one subfield of subfields of a frame are different from the duration of voltage rising period $T_{UP}$ and the duration of the voltage falling period $T_{DOWN}$ of the scan signal in the remaining subfields. For example, the duration of voltage rising period $T_{UP}$ of the scan signal in a subfield is less than the duration of voltage rising period $T_{UP}$ of the scan signal in the previous one or more subfields such that an address discharge occurs punctually. Further, the duration of voltage falling period $T_{DOWN}$ of the scan signal in a subfield is more than the duration of voltage falling period $T_{DOWN}$ of the scan signal in the previous one or more subfields such that a noise is efficiently reduced.

The duration of voltage rising period $T_{UP}$ and the duration of the voltage falling period $T_{DOWN}$ of the scan signal are lengthened, and for example, are equal to or more than 50 ns or 100 ns. As a result, a rate of change in voltage per an hour is relatively less than the related art, thereby greatly reducing a noise caused by the voltage rising and the voltage falling.

The duration of voltage rising period $T_{UP}$ may be more than the duration of the voltage falling period $T_{DOWN}$. This result in generating the exact address discharge and reducing the noise.

A difference between a maximum width and a minimum width of the scan signal decreases such that the address discharge occurs stably.

Further, a displacement current flowing in a driver integrated circuit (IC) is efficiently reduced such that an electrical damage of the driver IC is prevented.

Figure 6:
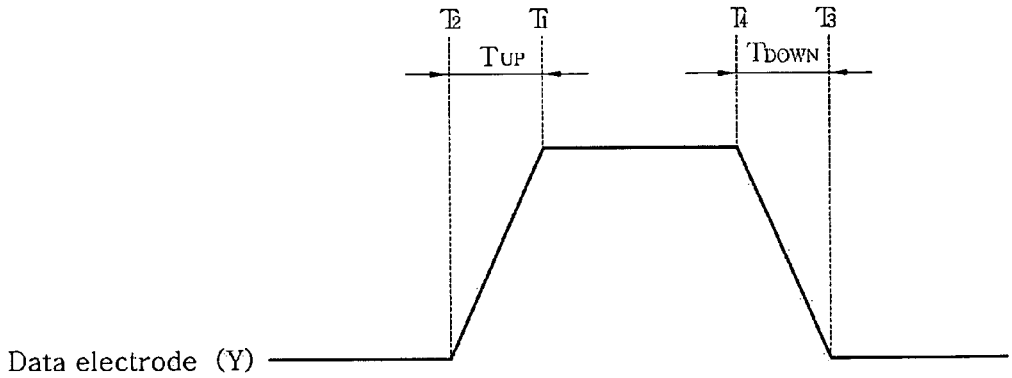
FIG. 6 illustrates a data signal supplied during an address period in the driving method of the plasma display apparatus according to the embodiment of the present invention.

FIG. 6 illustrates a data signal supplied during the address period in the driving method of the plasma display apparatus according to the embodiment of the present invention.

As illustrated in FIG. 6, the data driver 201 supplies the data signal synchronized with the scan signal during the address period. In the same way as the scan signal, the data signal has a voltage rising period $T_{UP}$ and a voltage falling period $T_{DOWN}$. The duration of the voltage rising period $T_{UP}$ ranges from a time point T1 to a time point T2, and the duration of the voltage falling period $T_{DOWN}$ ranges from a time point T3 to a time point T4. Since the duration, the control and the effect of each of the voltage rising period $T_{UP}$ and the voltage falling period $T_{DOWN}$ are described in FIG. 5, a description thereof is omitted.

Figure 7A:
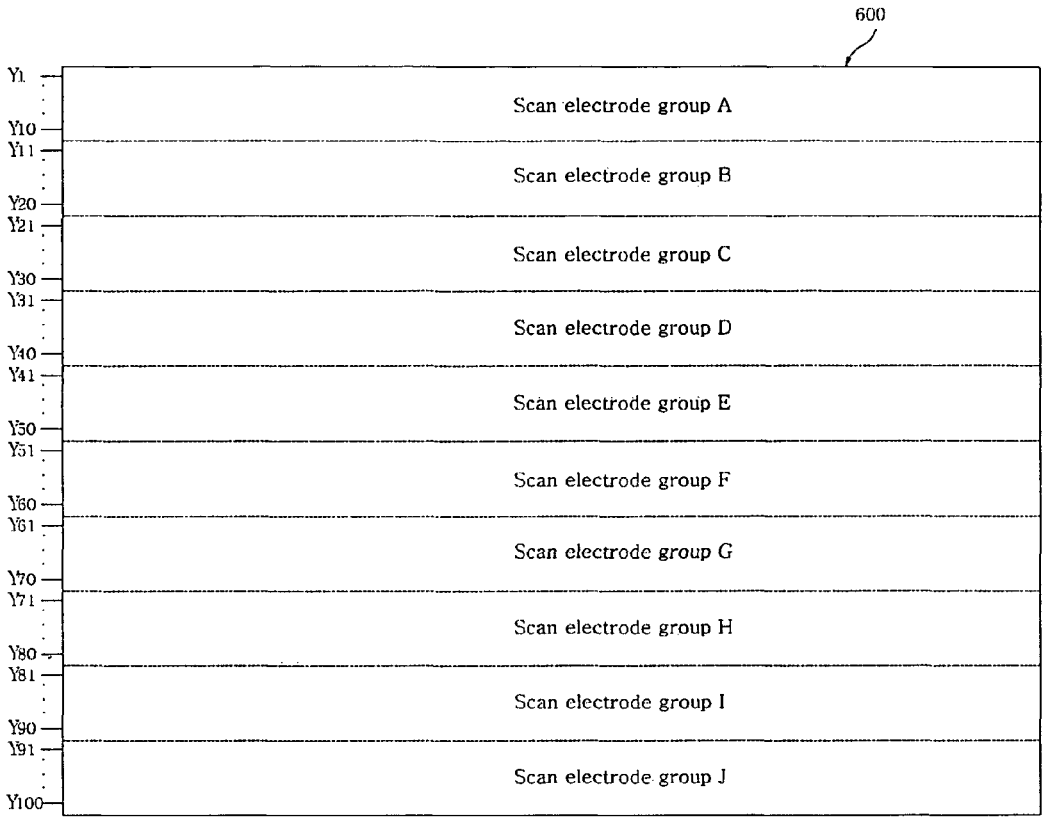
FIGS. 7*a* and 7*b* illustrate n example of a driving method of the plasma display apparatus according to the embodiment of the present invention, where a plurality of scan electrodes formed in the plasma display panel are divided into scan electrode groups.
Figure 7B:
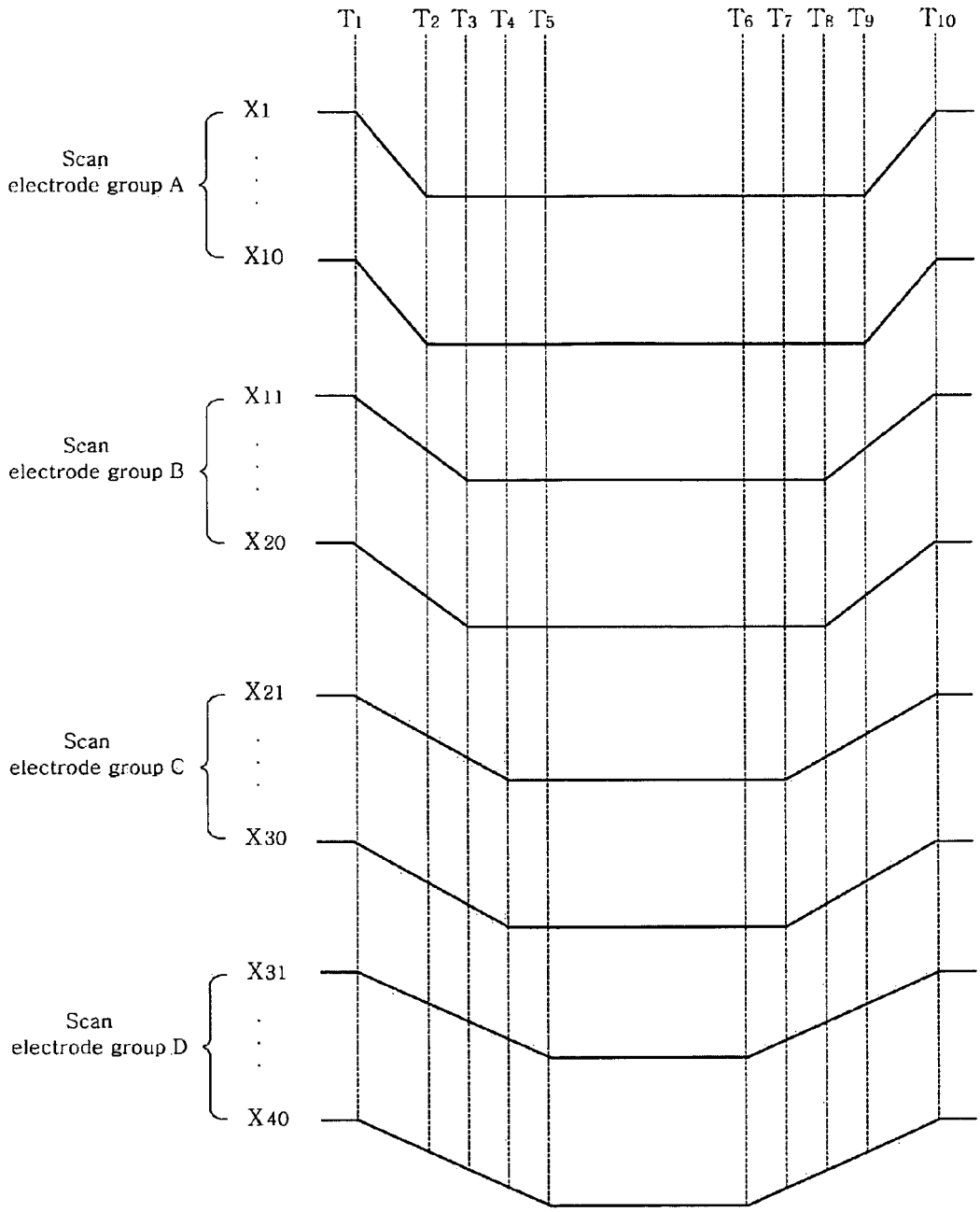

FIGS. 7*a* and 7*b* illustrate an example of a driving method of the plasma display apparatus according to the embodiment of the present invention, where a plurality of scan electrodes formed in the plasma display panel are divided into scan electrode groups.

As illustrated in FIG. 7*a*, assuming that the total number of scan electrodes formed on a plasma display panel 600 is equal to 100, 100 scan electrodes Y1 to Y100 are divided into a scan electrode group A including scan electrodes Y1 to Y10, a scan electrode group B including scan electrodes Y11 to Y20, a scan electrode group C including scan electrodes Y21 to Y30, a scan electrode group D including scan electrodes Y31 to Y40, a scan electrode group E including scan electrodes Y41 to Y50, a scan electrode group F including scan electrodes Y51 to Y60, a scan electrode group G including scan electrodes Y61 to Y70, a scan electrode group H including scan electrodes Y71 to Y80, a scan electrode group I including scan electrodes Y81 to Y90, and a scan electrode group J including scan electrodes Y91 to Y100. In FIG. 7*a*, each of the scan electrode groups includes 10 scan electrodes. However, each of the scan electrode groups includes a different number of scan electrodes.

The number of scan electrode groups is 2 or more and is less than the total number of scan electrodes. In other words, when the total number of scan electrodes is equal to n, the number N of scan electrode groups is set to a range of $2\leqq N\leqq(n-1)$. It is preferable that the number of scan electrode groups ranges from 2 to 4 in consideration of factors such as the size of a scan driver board.

At least one of a voltage rising period or a voltage falling period of a scan signal supplied to the plurality of scan electrode groups is controlled. This will be described in detail below with reference to FIG. 7*b*.

As illustrated in FIG. 7*b*, at least one of a voltage rising period or a voltage falling period of a scan signal supplied to at least one of the plurality of scan electrode groups including one or more scan electrodes is different from at least one of a voltage rising period or a voltage falling period of a scan signal supplied to the remaining scan electrode groups.

As illustrated in FIG. 7*b*, the duration of a voltage falling period of a scan signal supplied to the scan electrode group A ranges from a time point T2 to a time point T1. The duration of a voltage falling period of a scan signal supplied to the scan electrode group B ranges from a time point T3 to a time point T1. The duration of a voltage falling period of a scan signal supplied to the scan electrode group C ranges from a time point T4 to a time point T1. The duration of a voltage falling period of a scan signal supplied to the scan electrode group D ranges from a time point T5 to a time point T1. In other words, the durations of the voltage falling periods of the scan signals of the scan electrode groups A, B, C and D are different from one another. Further, the duration of a voltage rising period of the scan signal supplied to the scan electrode group A ranges from a time point T10 to a time point T9. The duration of a voltage rising period of the scan signal supplied to the scan electrode group B ranges from a time point T10 to a time point T8. The duration of a voltage rising period of the scan signal supplied to the scan electrode group C ranges from a time point T10 to a time point T7. The duration of a voltage rising period of the scan signal supplied to the scan electrode group D ranges from a time point T10 to a time point T6. In other words, the durations of the voltage rising periods of the scan signals of the scan electrode groups A, B, C and D are different from one another.

The duration of a voltage falling period of a scan signal of all scan electrode groups ranges from the time point T2 to the time point T1, thereby punctually generating the address discharge. Further, the duration of the voltage rising period of the scan signal is controlled as illustrated in FIG. 7*b*, thereby efficiently reducing a noise.

The duration of the voltage rising period and the duration of the voltage falling period of the scan signal are different in each scan electrode group. The duration of the voltage rising period and the voltage falling period of the scan signal are equal in the scan electrodes of the same scan electrode group.

In the same way as the scan electrode, the plasma display apparatus, where the data electrodes are divided into data electrode groups, can be driven. Since a driving method of the plasma display apparatus, where the data electrodes are divided into data electrode groups, is the same as the driving method of the plasma display apparatus, where the scan electrodes are divided into the scan electrode groups, a description thereof is omitted.

Figure 8:
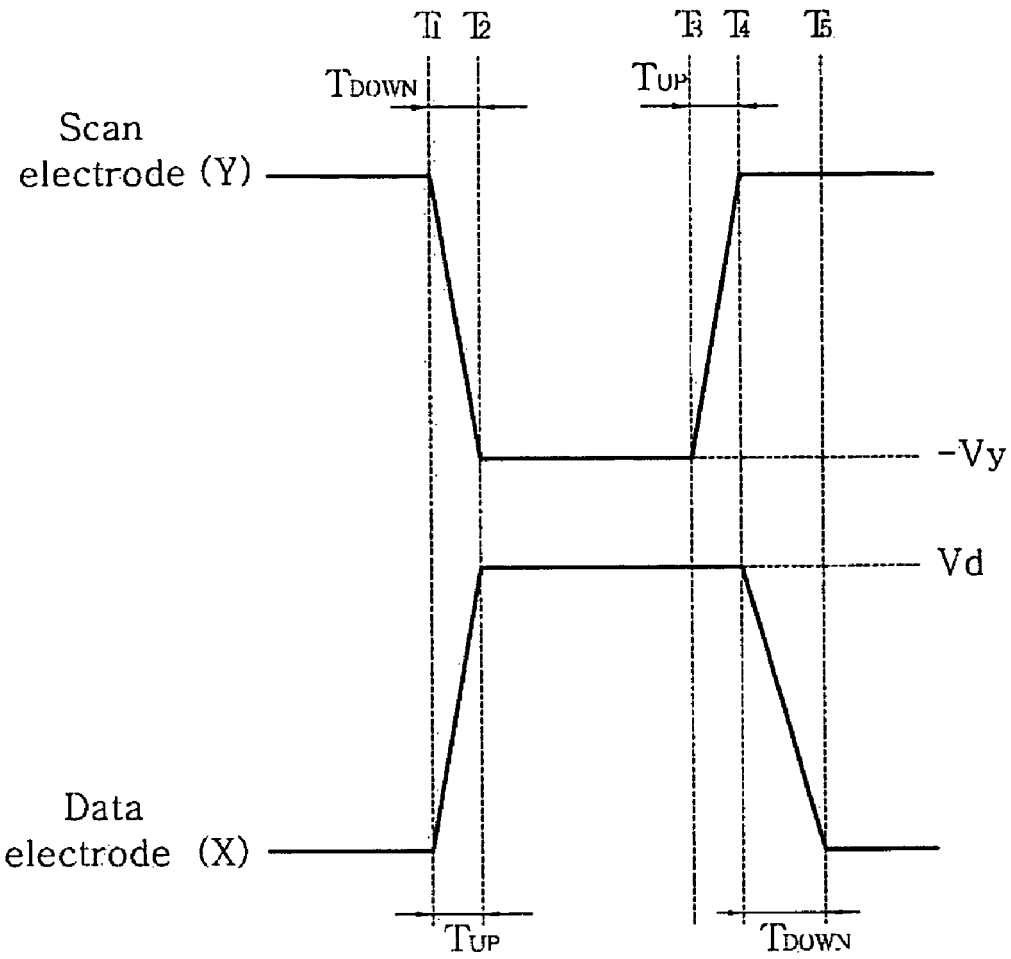
FIG. 8 illustrates a scan signal and a data signal synchronized with the scan signal in the driving method of the plasma display apparatus according to the embodiment of the present invention.

FIG. 8 illustrates a scan signal and a data signal synchronized with the scan signal in the driving method of the plasma display apparatus according to the embodiment of the present invention.

As illustrated in FIG. 8, during the address period, the scan signal and the data signal synchronized with the scan signal are supplied to generate the address discharge. A supply time point of the scan signal may be equal to a supply time point of the data signal. The duration of a voltage falling period $T_{DOWN}$ of the scan signal and the duration of a voltage rising period $T_{UP}$ of the data signal range from a time point T1 to a time point T2. As a result, the address discharge occurs punctually.

Further, a supply period of the scan signal may not overlap a supply period of the data signal. For example, the duration of a voltage rising period $T_{UP}$ of the scan signal ranges from a time point T3 to a time point T4. The duration of a voltage falling period $T_{DOWN}$ of the data signal ranges from a time point T4 to a time point T5. Since voltages of the scan signal and the data signal do not change simultaneously, a noise caused by a voltage change decreases.

In the driving method of the plasma display apparatus according to the embodiment of the present invention, the voltage rising period and the voltage falling period of the scan signal supplied for scanning the plurality of scan electrodes Y during the address period may be different. Further, the plurality of scan electrodes Y may be scanned during the address period in one scanning type of the plurality of scanning types having different scanning orders.

One scanning type is selected from of the plurality of scanning type in consideration of factors such as the number of switching operation times of the data driver IC or data load in accordance with the image data. In other words, the displacement current may change due to the factors. The following is a detailed description of a change in a displacement current, with reference to FIG. 9.

Figure 9:
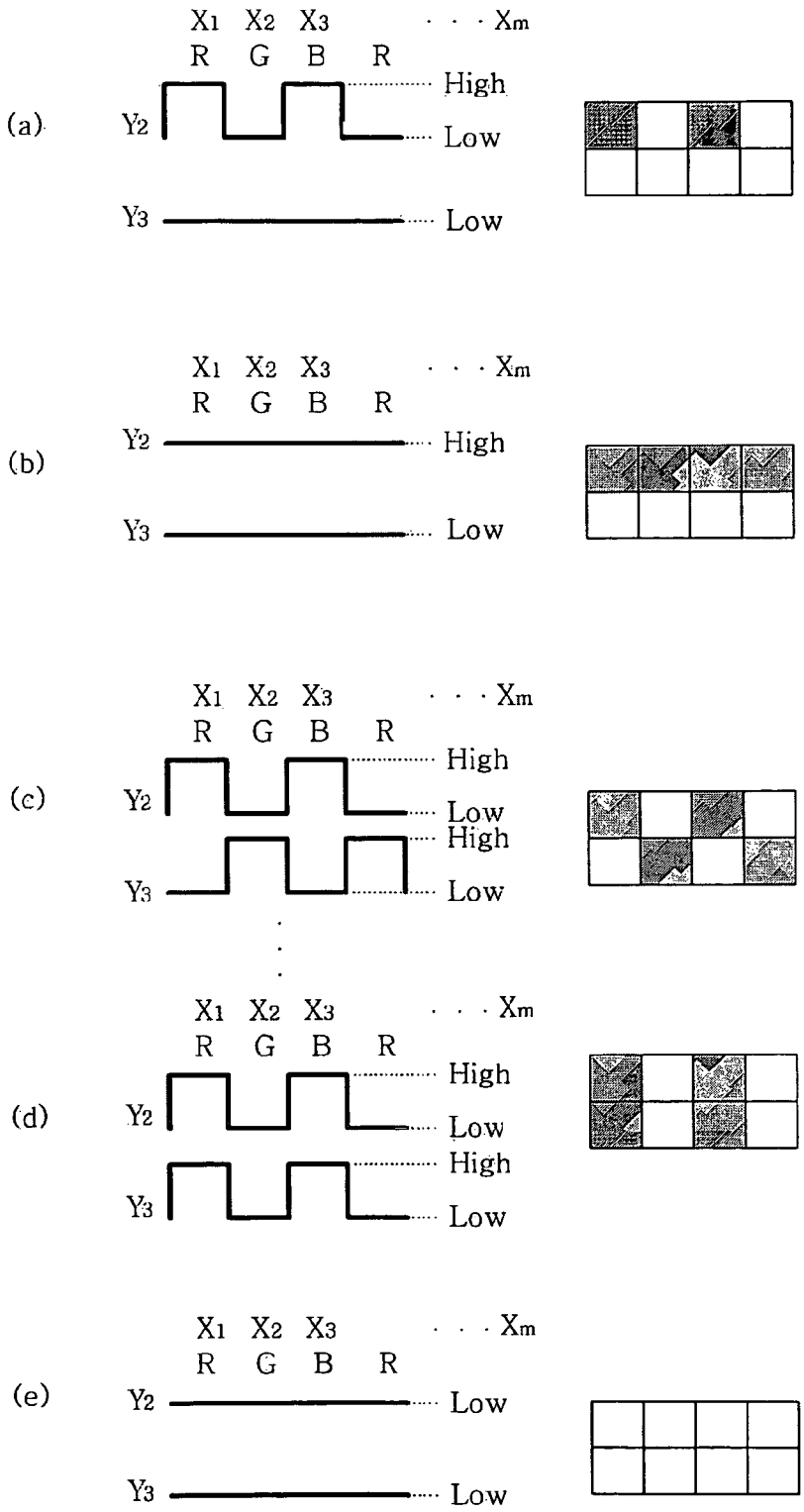
FIG. 9 illustrates a change in a displacement current in accordance with image data.

FIG. 9 illustrates a change in a displacement current in accordance with image data.

As illustrated in (a) of FIG. 9, when a second scan electrode Y2 is scanned (the scan signal is supplied to the second scan electrode Y2), image data alternately having logical values of 1 (High) and 0 (Low) is applied to the data electrodes X1 to Xm. At this time, the number of switching operation times of the data driver IC is determined in accordance with a pattern of the image data.

When a third scan electrode Y3 is scanned, image data maintained at a logical value of 0 is applied to the data electrodes X1 to Xm. The logical value of 1 refers to a state where the data voltage Vd of the data signal is supplied to the corresponding data electrode X. The logical value of 0 refers to a state where 0V is supplied to the corresponding data electrode X (i.e., the data voltage is not supplied to the corresponding data electrode X).

In other words, image data alternately having logical values of 1 and 0 is applied to a discharge cell on a scan electrode, and then image data maintained at a logical value of 0 is applied to a discharge cell on a next scan electrode. At this time, a displacement current Id flowing in each data electrode is expressed by the following equation 1.

$$Id=\tfrac{1}{2}(Cm1+Cm2)Vd \qquad \text{(Equation 1)}$$

Id: Displacement current flowing in each data electrode

Cm1: Equivalence capacitance between data electrodes

Cm2: Equivalence capacitance between data electrode and scan electrode or between data electrode and sustain electrode Vd: Voltage of data signal supplied to each data electrode As illustrated in (b) of FIG. 9, when the second scan electrode Y2 is scanned, image data maintained at a logical values of 1 is applied to the data electrodes X1 to Xm. When the third scan electrode Y3 is scanned, image data maintained at a logical value of 0 is applied to the data electrodes X1 to Xm. As described above, the logical value of 0 refers to a state where 0V is supplied to the corresponding data electrode X (i.e., the data voltage is not supplied to the corresponding data electrode X).

In other words, image data maintained at a logical value of 1 is applied to a discharge cell on a scan electrode, and then image data maintained at a logical value of 0 is applied to a discharge cell on a next scan electrode. Further, image data maintained at a logical value of 0 may be applied to a discharge cell on a scan electrode, and then image data maintained at a logical value of 1 may be applied to a discharge cell on a next scan electrode.

At this time, a displacement current Id flowing in each data electrode is expressed by the following equation 2.

$$Id=\frac{1}{2}(Cm2)Vd \quad \text{(Equation 2)}$$

Id: Displacement current flowing in each data electrode

Cm2: Equivalence capacitance between data electrode and scan electrode or between data electrode and sustain electrode Vd: Voltage of data signal supplied to each data electrode As illustrated in (c) of FIG. 9, when the second scan electrode Y2 is scanned, image data alternately having logical values of 1 and 0 is applied to the data electrodes X1 to Xm. At this time, the number of switching operation times of the data driver IC is determined in accordance with a pattern of the image data. Further, when the third scan electrode Y3 is scanned, image data alternately having logical values of 0 and 1 is applied to the data electrodes X1 to Xm so that a difference between a phase of the image data applied to the discharge cell on the second scan electrode Y2 and a phase of the image data applied to the data electrodes X1 to Xm is equal to 180°.

In other words, image data alternately having logical values of 1 and 0 is applied to a discharge cell on a scan electrode. Then, image data alternately having logical values of 0 and 1 is applied to a discharge cell on a next scan electrode so that a difference between a phase of the image data applied to the discharge cell on the scan electrode and a phase of the image data applied to the next scan electrode is equal to 180°.

At this time, a displacement current Id flowing in each data electrode is expressed by the following equation 3.

$$Id=\frac{1}{2}(4Cm1+Cm2)Vd \quad \text{(Equation 3)}$$

Id: Displacement current flowing in each data electrode

Cm1: Equivalence capacitance between data electrodes

Cm2: Equivalence capacitance between data electrode and scan electrode or between data electrode and sustain electrode Vd: Voltage of data signal supplied to each data electrode As illustrated in (d) of FIG. 9, when the second scan electrode Y2 is scanned, image data alternately having logical values of 1 and 0 is applied to the data electrodes X1 to Xm. At this time, the number of switching operation times of the data driver IC is determined in accordance with a pattern of the image data. Further, when the third scan electrode Y3 is scanned, image data alternately having logical values of 1 and 0 is applied to the data electrodes X1 to Xm so that a phase of the image data applied to the discharge cell on the second scan electrode Y2 is equal to a phase of the image data applied to the data electrodes X1 to Xm.

In other words, image data alternately having logical values of 1 and 0 is applied to a discharge cell on a scan electrode. Then, image data alternately having logical values of 1 and 0 is applied to a discharge cell on a next scan electrode so that a phase of the image data applied to the discharge cell on the scan electrode is equal to a phase of the image data applied to the next scan electrode.

At this time, a displacement current Id flowing in each data electrode is expressed by the following equation 4.

$$Id=0 \quad \text{(Equation 4)}$$

Id: Displacement current flowing in each data electrode

Cm2: Equivalence capacitance between data electrode and scan electrode or between data electrode and sustain electrode Vd: Voltage of data signal supplied to each data electrode As illustrated in (e) of FIG. 9, when the second scan electrode Y2 is scanned, image data maintained at a logical values of 0 is applied to the data electrodes X1 to Xm. When the third scan electrode Y3 is scanned, image data maintained at a logical value of 0 is applied to the data electrodes X1 to Xm.

In other words, image data maintained at a logical value of 0 is applied to a discharge cell on a scan electrode, and then image data maintained at a logical value of 0 is applied to a discharge cell on a next scan electrode.

Further, image data maintained at a logical value of 1 may be applied to a discharge cell on a scan electrode, and then image data maintained at a logical value of 1 may be applied to a discharge cell on a next scan electrode.

At this time, a displacement current Id flowing in each data electrode is expressed by the following equation 5.

$$Id=0 \quad \text{(Equation 5)}$$

Id: Displacement current flowing in each data electrode

Cm2: Equivalence capacitance between data electrode and scan electrode or between data electrode and sustain electrode Vd: Voltage of data signal supplied to each data electrode As can be seen from the above equations 1 to 5, when image data alternately having logical values of 1 and 0 is applied to a discharge cell on a scan electrode, and then image data alternately having logical values of 0 and 1 is applied to a discharge cell on a next scan electrode so that a difference between a phase of the image data applied to the discharge cell on the scan electrode and a phase of the image data applied to the next scan electrode is equal to 180°, a displacement current with a maximum value flows in the data electrode.

On the other side, when image data alternately having logical values of 1 and 0 is applied to a discharge cell on a scan electrode, and then, image data alternately having logical values of 1 and 0 is applied to a discharge cell on a next scan electrode so that a phase of the image data applied to the discharge cell on the scan electrode is equal to a phase of the image data applied to the next scan electrode, a displacement current with a minimum value flows in the data electrode.

In other words, as illustrated in (c) of FIG. 9, when image data having different logical values is alternately supplied, a maximum displacement current flows, thereby making possible to electrically damage the data driver IC.

Figure 10A:
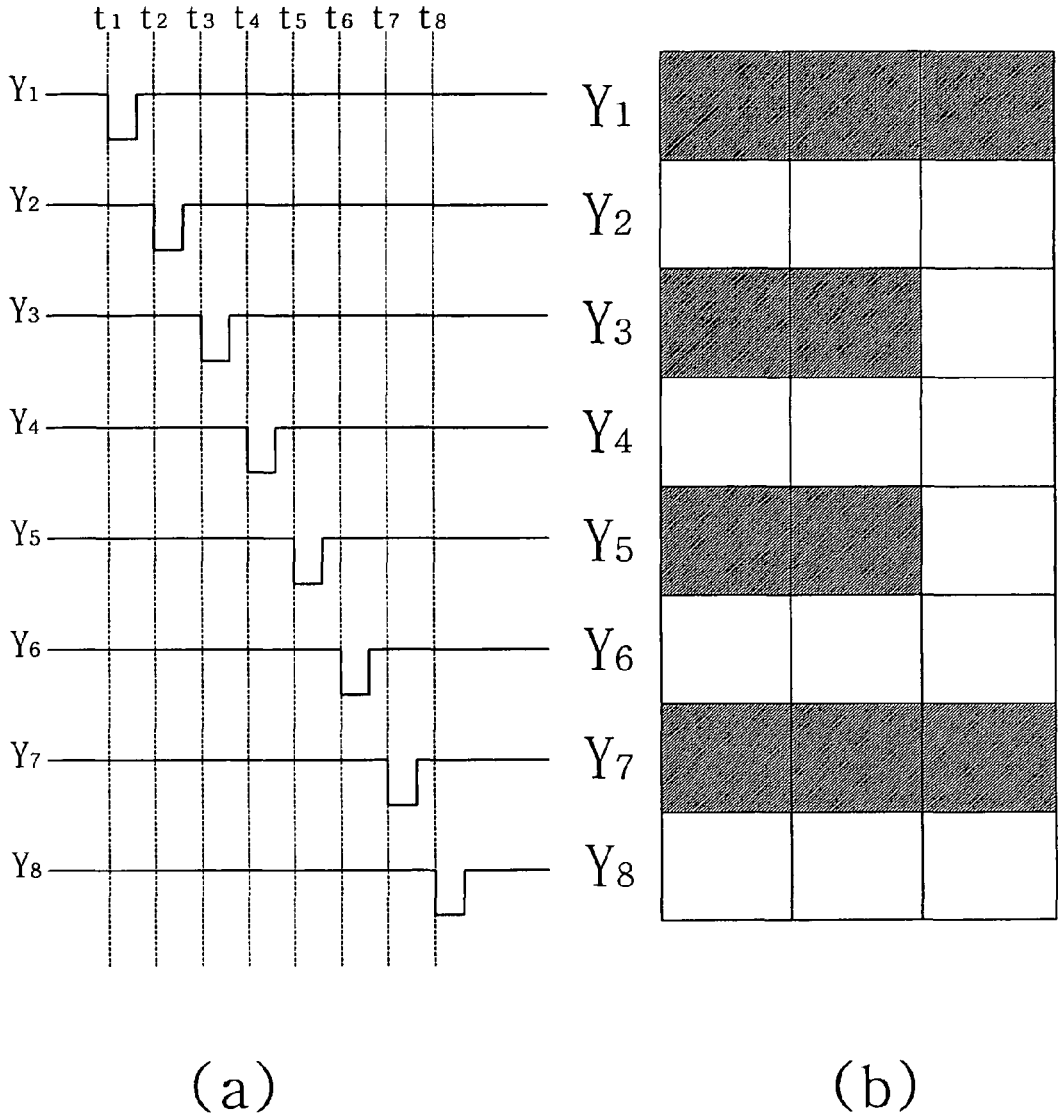
FIGS. 10*a* and 10*b* illustrate an example of a method for changing scanning order in consideration of image data and a displacement current changed in accordance with the image data.
Figure 10B:
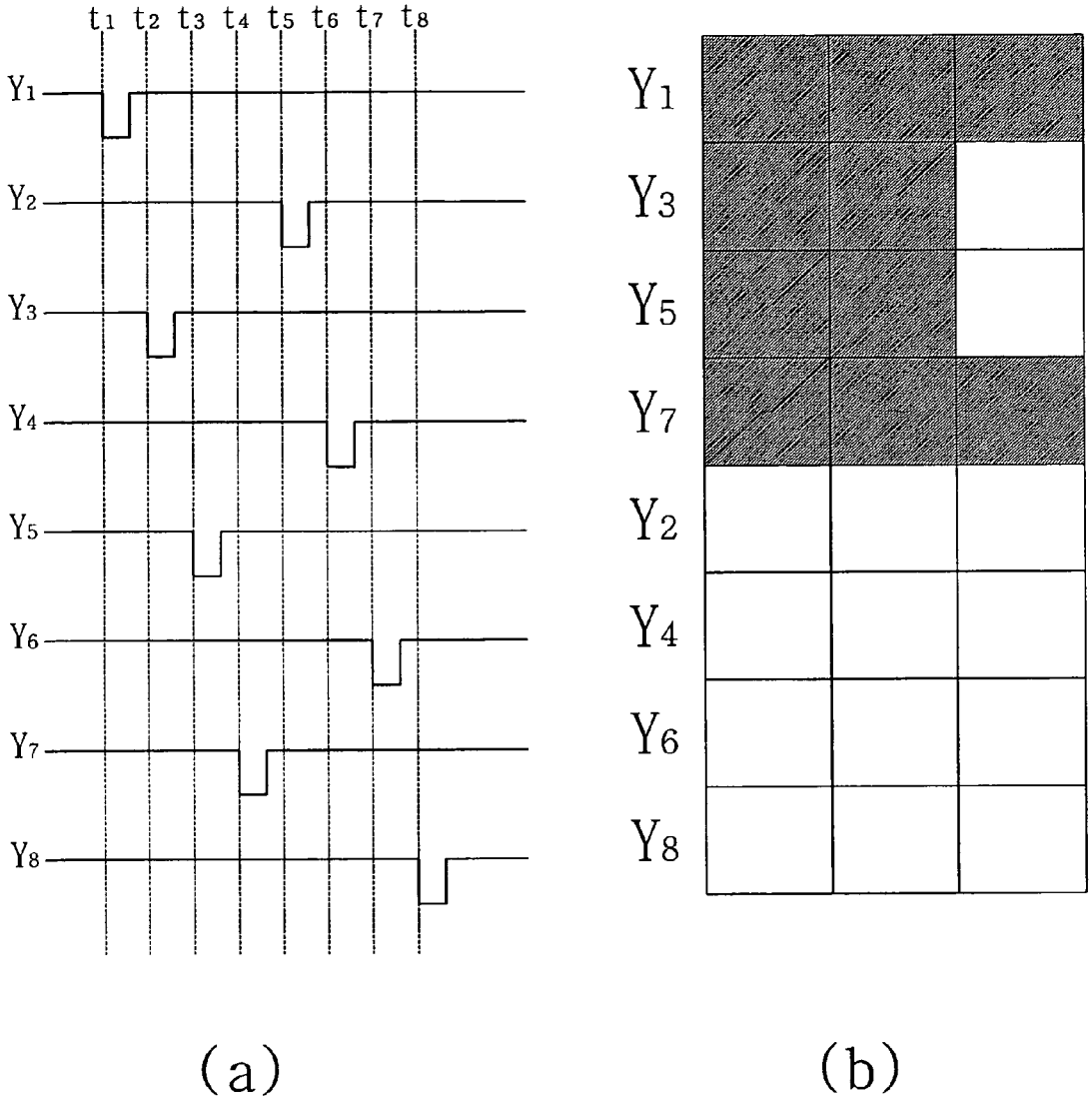

The following is a detailed description of an example of a method for changing scanning order in consideration of the number of switching operation times of the data driver IC or data load, or the displacement current in accordance with the image data, with reference to FIGS. 10*a* and 10*b*.

FIGS. 10*a* and 10*b* illustrate an example of a method for changing scanning order in consideration of image data and a displacement current in accordance with the image data.

FIGS. 10*a* and 10*b* illustrate the same image data in which scanning order is different.

As illustrated in FIG. 10*a*, when image data of (b) of FIG. 10*a* is supplied and the scan electrodes are scanned in order illustrated in (a) of FIG. 10*a* , the frequency of changes in the logical values of the image data is relatively high in an arrangement direction of scan electrodes. Accordingly, the number of switching operation times of the data driver IC increases and a large displacement current flows.

As illustrated in FIG. 10*b* , when the scan electrodes are scanned in scanning order as illustrated in (a) of FIG. 10*b* , image data as illustrated in (b) of FIG. 10*a* is arranged. Therefore, the frequency of changes in the logical values of the image data decreases in an arrangement direction of scan electrodes. Further, the number of switching operation times of the data driver IC increases and a displacement current decreases.

As a result, since the scanning order of the scan electrodes is controlled depending on the image data as illustrated in FIG. 10*b*, an influence on a change in a voltage between the electrodes can be minimized. Accordingly, the displacement current flowing in the data diver IC decreases such that the electrical damage of the data diver IC is prevented.

Figure 11:
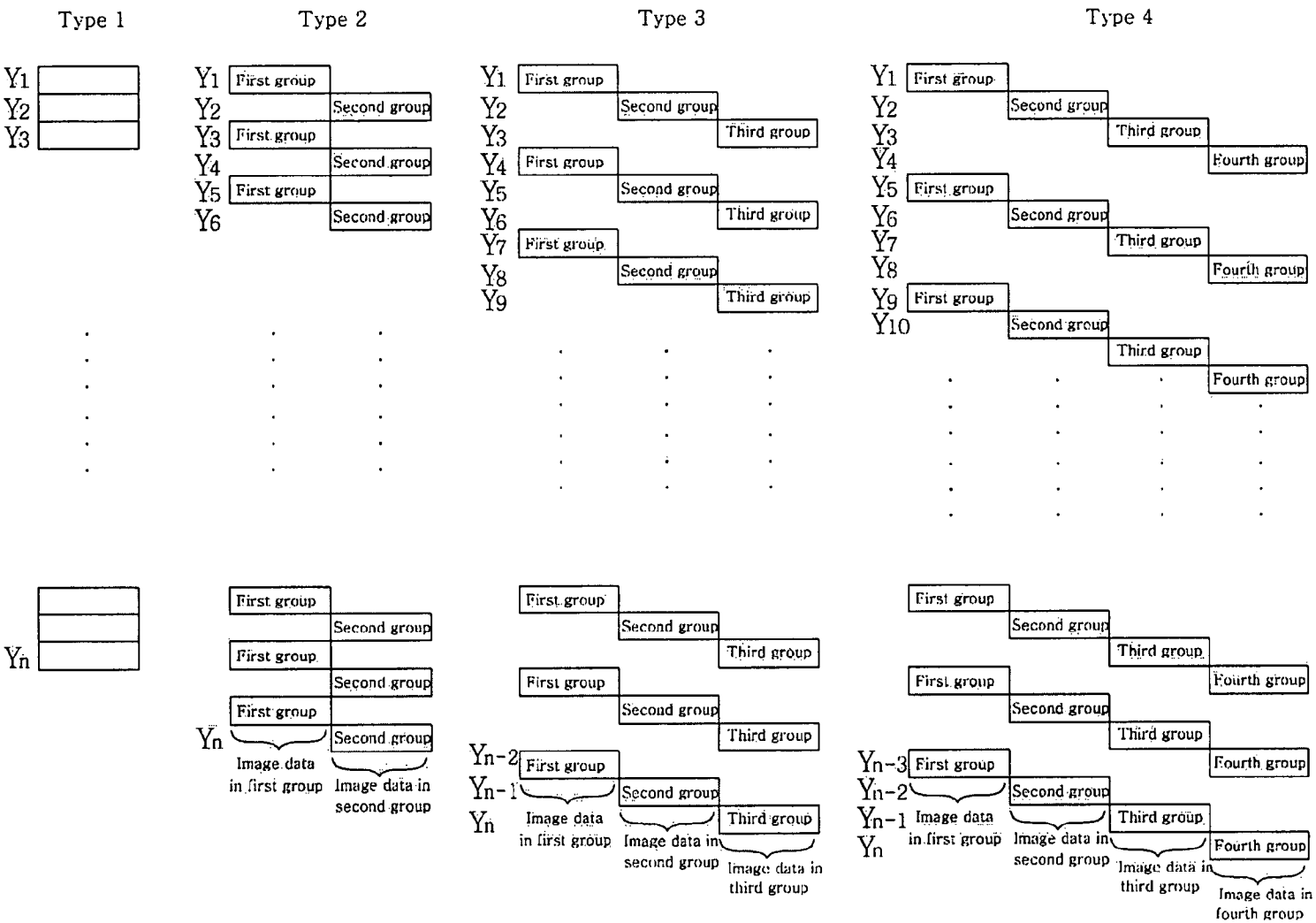
FIG. 11 illustrates another example of the driving method of the plasma display apparatus according to the embodiment of the present invention.

FIG. 11 illustrates another example of the driving method of the plasma display apparatus according to the embodiment of the present invention.

As illustrated in FIG. 11, the driving method of the plasma display apparatus according to the embodiment of the present invention may perform a scanning operation in one scanning type of four scanning types, for example, a first scanning type (Type 1), a second scanning type (Type 2), a third scanning type (Type 3) and a fourth scanning type (Type 4).

In the first scanning type, the scan electrodes are scanned in arrangement order of the scan electrodes (i.e., in order of a first scan electrode Y1, a second scan electrode Y2, third scan electrode Y3, . . . ).

In the second scanning type, scan electrodes of a first group are sequentially scanned, and then scan electrodes of a second group are sequentially scanned. That is, a first scan electrode Y1, a third scan electrode Y3, a fifth electrode Y5, . . . , a (n−1)-th scan electrode Yn−1 are sequentially scanned, and then a second scan electrode Y2, a fourth scan electrode Y4, a sixth scan electrode Y6, . . . , a n-th scan electrode Yn are sequentially scanned.

In the third scanning type, scan electrodes of a first group are sequentially scanned, scan electrodes of a second group are sequentially scanned, and scan electrodes of a third group are sequentially scanned. That is, a first scan electrode Y1, a fourth scan electrode Y4, a seventh electrode Y7, . . . , a (n−2)-th scan electrode Yn−2 are sequentially scanned, a second scan electrode Y2, a fifth scan electrode Y5, an eighth scan electrode Y8, . . . , a (n−1)th scan electrode Yn−1 are sequentially scanned, and then a third scan electrode Y3, a sixth scan electrode Y6, a ninth electrode Y9, . . . , a n-th scan electrode Yn are sequentially scanned.

In the fourth scanning type, scan electrodes of a first group are sequentially scanned, scan electrodes of a second group are sequentially scanned, scan electrodes of a third group are sequentially scanned, and scan electrodes of a fourth group are sequentially scanned. That is, a first scan electrode Y1, a fifth scan electrode Y5, a ninth electrode Y9, . . . , a (n−3)-th scan electrode Yn−3 are sequentially scanned, a second scan electrode Y2, a sixth scan electrode Y6, a tenth scan electrode Y10, . . . , a (n−2)th scan electrode Yn−1 are sequentially scanned, a third scan electrode Y3, a seventh scan electrode Y7, . . . , an eleventh scan electrode Y11, . . . , a (n−1)th scan electrode Yn−1 are sequentially scanned, and a fourth scan electrode Y4, an eighth scan electrode Y8, a twelfth electrode Y12, . . . , a n-th scan electrode Yn are sequentially scanned.

The explanation was given of an example of scanning the scan electrodes in one scanning type of the four scanning types, in FIG. 11. However, the scan electrodes may be scanned in one scanning type selected from various number of scanning types such as two scanning types, three scanning types, five scanning types.

Figure 12:
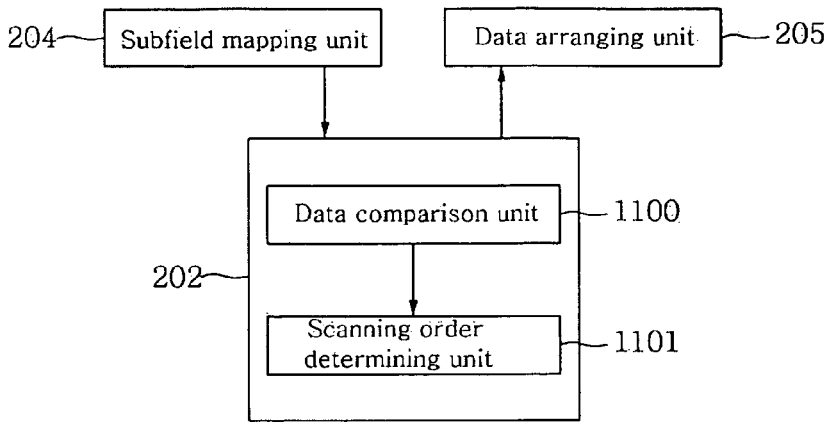
FIG. 12 illustrates the structure of an operation of a scan driver in the driving method of the plasma display apparatus according to the embodiment of the present invention.

FIG. 12 illustrates the structure and an operation of a scan driver in the method of driving the plasma display apparatus according to the embodiment of the present invention.

As illustrated in FIG. 12, the scan driver 202 may comprise a data comparison unit 1100 and a scanning order determining unit 1101.

The data comparison unit 1100 receives the image data mapped by the subfield mapping unit 204. Then, the data comparison unit 1100 compares image data of a bundle of one or more discharge cells located in a specific scan electrode line with a bundle of discharge cells adjacent to the bundle of cells in accordance with each of a plurality of scanning types to calculate a displacement current.

The bundle of cells means that one or more cells form one unit cell. For example, R, G and B discharge cells forms one pixel, and thus, one pixel may be a bundle of cells.

The scanning order determining unit 1101 determines scanning order based on the minimum displacement current by use of information on the displacement current calculated by the data comparison unit 1100.

The data arranging unit 205 receives information on the scanning order determined by the scanning order determining unit 1101. The data arranging unit 205 rearranges the image data mapped by the subfield mapping unit 204 in accordance with the scanning order determined by the scanning order determining unit 1101, and then, supplies the rearranged image data to the data electrode X.

The data comparison unit 1100 calculates the number of switching operation times of the data driver IC or data load or a displacement current in accordance with each of the four scanning types of FIG. 11. More specifically, the data comparison unit 1100 receives information on the number of switching operation times of the data driver IC or data load or the displacement current in accordance with each of the four scanning types of FIG. 11. Then, the scanning order determining unit 1101 compares the displacement current or the number of switching operation times of the data driver IC or the data load in accordance with each of the four scanning types. The scanning order determining unit 1101 selects the scanning type, in which there is the minimum number of switching operation times of the data driver IC or there is a minimum data load or there is a minimum displacement current, as the scanning type with a displacement current equal to or less than a critical displacement current.

The scanning order determining unit 1101 may select any one of the first, third and fourth scanning types except the second scanning type.

The data driver is previously set to the critical displacement current. Then, the scanning types in which the displacement current equal to or less than the critical displacement current is generated, may be selected.

Figure 13:
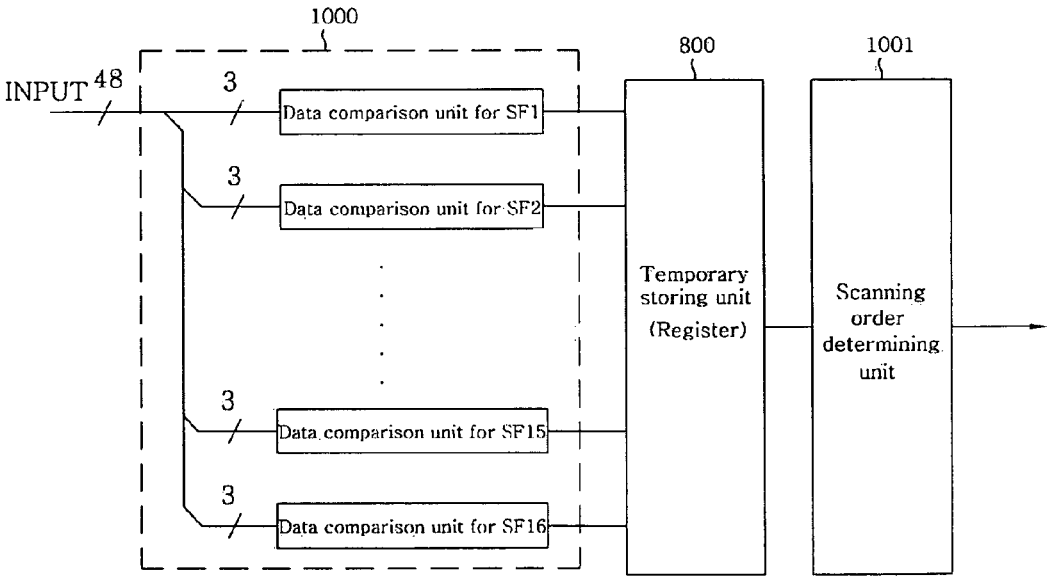
FIG. 13 is a block diagram of an example where a data comparison unit and a scanning order determining unit according to the embodiment of the present invention are applied to each subfield.

FIG. 13 is a block diagram of an example where a data comparison unit and a scanning order determining unit according to the embodiment of the present invention are applied to each subfield.

Referring to FIG. 13, a data comparison unit for a first subfield SF1 to a data comparison unit for a sixteenth subfield SF16 each calculate the displacement current in accordance with image data in the corresponding subfields in accordance with the plurality of scanning types to store the calculated displacement in a temporary storing unit 800.

Figure 17:
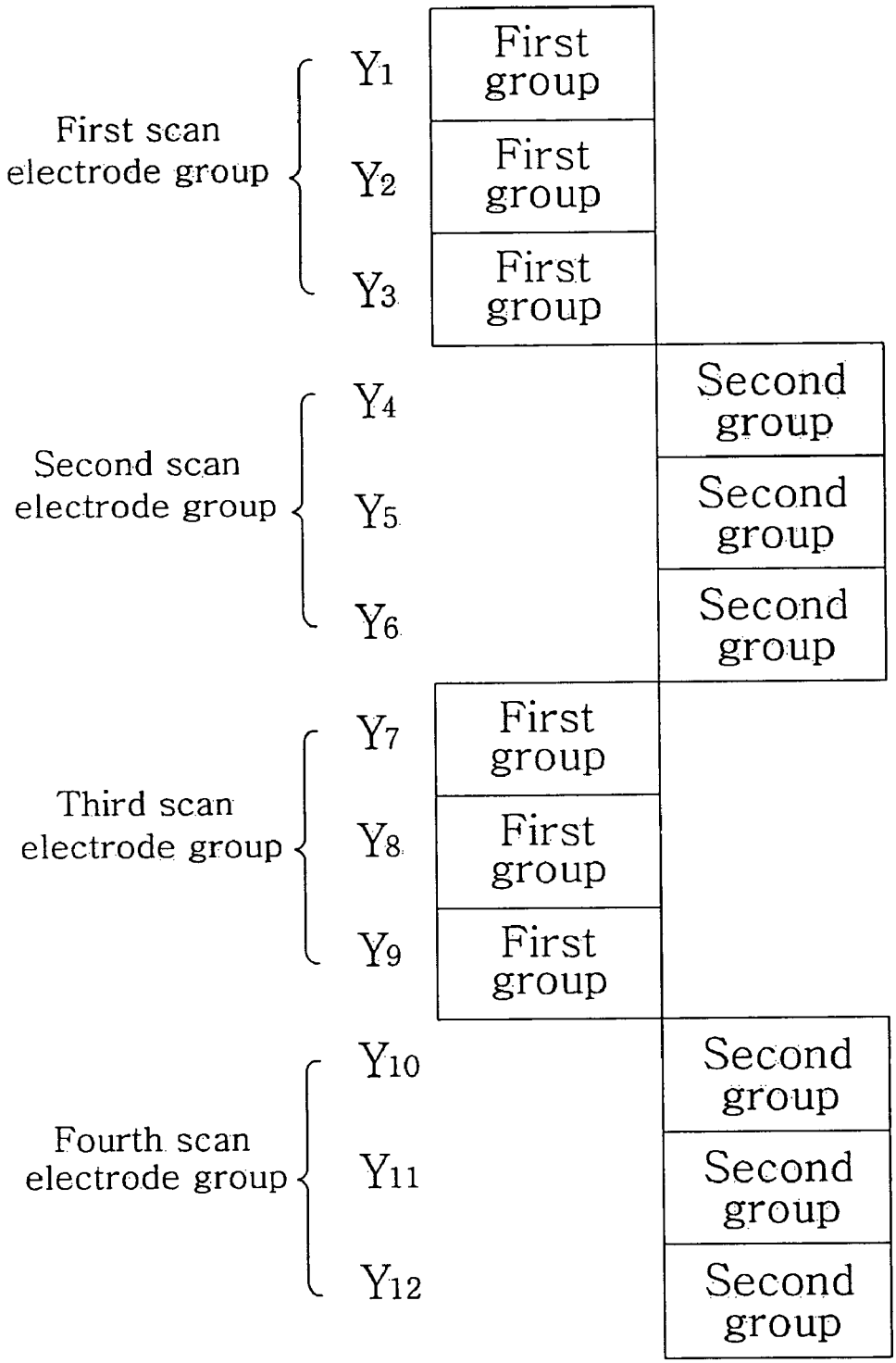
FIG. 17 illustrates an example of a method for determining scanning order in accordance with scan electrode groups including a plurality of scan electrodes.

The structure of data comparison units for the first subfield SF1 to the sixteenth subfield SF16 is the same as the structure of a data comparison unit of FIG. 17. Each of the data comparison units for the first subfield SF1 to the sixteenth subfield SF16 calculates the displacement current in accordance with a pattern of image data in the corresponding subfields in accordance with the plurality of scanning types to store the calculated displacement in the temporary storing unit 800.

The scanning order determining unit 1101 compares the displacement currents in accordance with a pattern of image data in each subfield supplied from the temporary storing unit 800. Then the scanning order determining unit 1101 finds out a pattern of image data of the minimum displacement current to determine the scanning order in each subfield.

In each of the four scanning types illustrated in FIG. 11, a displacement current between the predetermine number of scan lines spaced a regular distance apart from one another is calculated. Then, the scanning type of the minimum displacement current is selected. However, a displacement current between the scan lines spaced a random distance apart from one another may be calculated, and then the scanning type of the minimum displacement current may be selected.

The displacement current is calculated using weight (Cm2, Cm1+Cm2 or 4Cm1+Cm2) including at least one of the capacitances Cm1 and Cm2. However, when no displacement current flows, a displacement current is indicated by u0, and when a displacement current flows, a displacement current is indicated by u1. Then, the displacement current in the subfield may be calculated using a sum of displacement currents u0 and u1.

Figure 14:
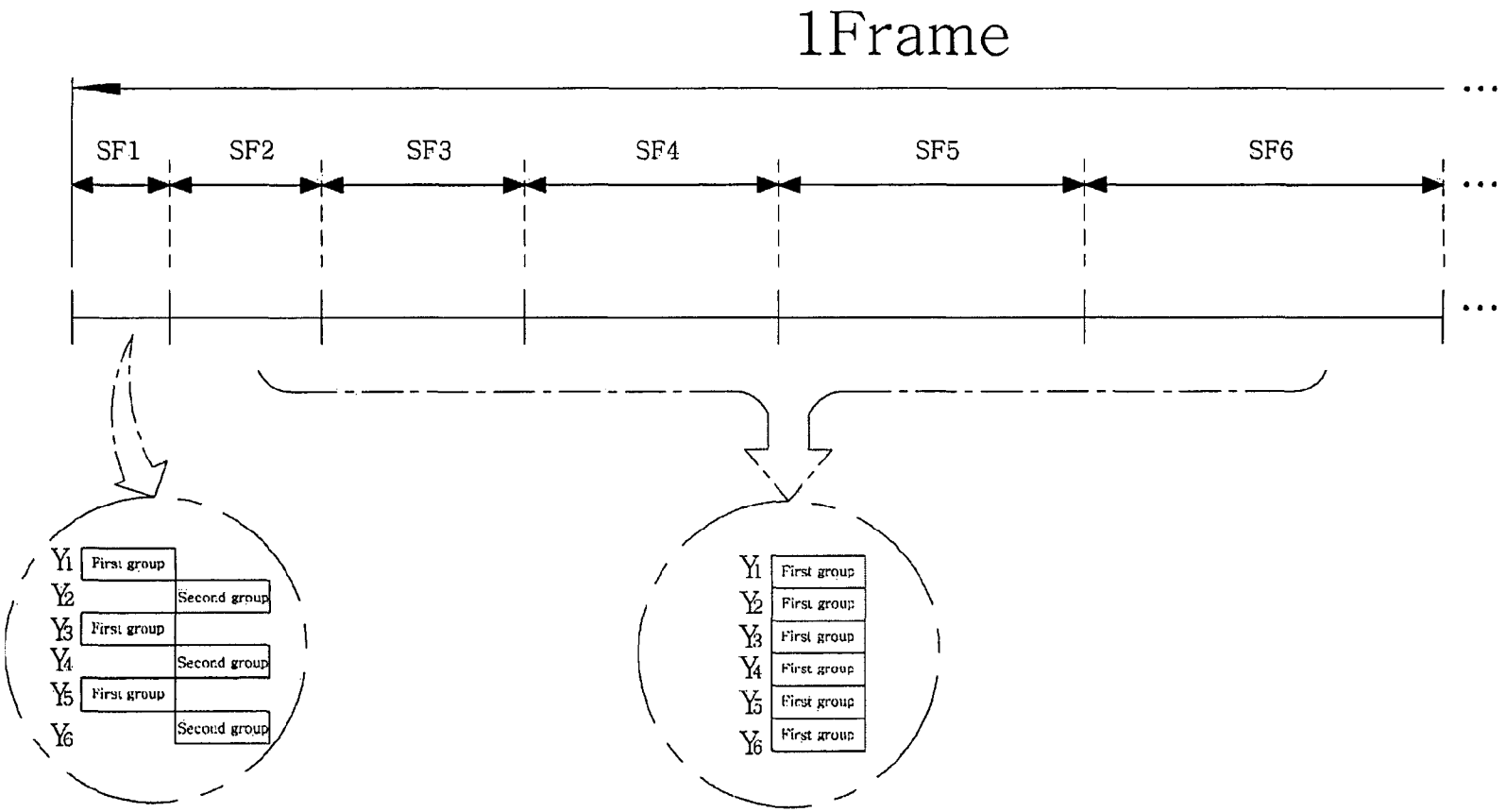
FIG. 14 illustrates an example for selecting a subfield of a frame in which scan electrodes are scanned in one scanning type of a plurality of scanning types.

FIG. 14 illustrates an example for selecting a subfield of a frame during which scan electrodes are scanned in one scanning type of a plurality of scanning types.

As illustrated in FIG. 14, when subfields of a frame are arranged in increasing order of gray level weight, the scan electrodes are scanned in the second scanning type of FIG. 11 in a first subfield SF1 of the lowest gray weight. The scan electrodes are sequentially scanned in the first scanning type of FIG. 11 in the remaining subfields.

In other words, in at least one subfield of subfields of a frame, the number of switching operation times of the data driver IC or the data load or the displacement current are calculated in the plurality of scanning types. Then, the scan electrodes are scanned in the scanning type, in which there is the minimum number of switching operation times of the data driver IC or there is a minimum data load or there is a minimum displacement current.

Figure 15:
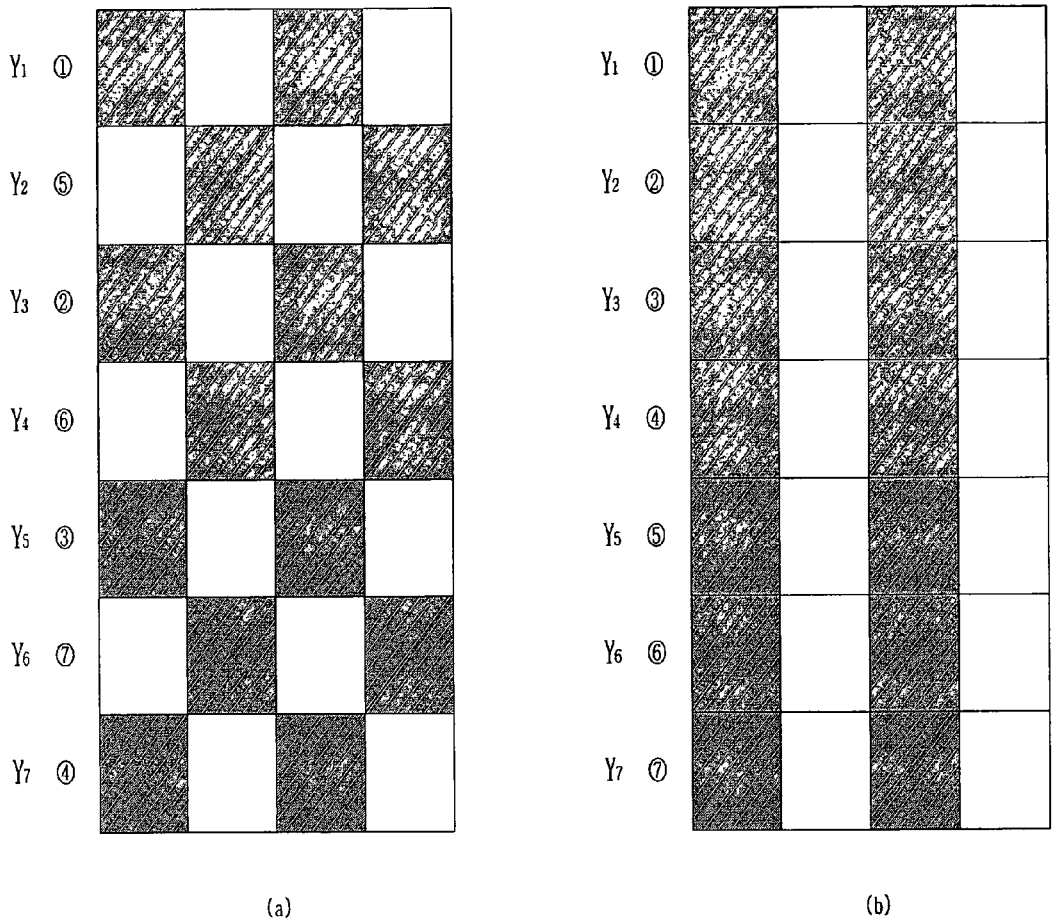
FIG. 15 illustrates different scanning order in two different patterns of image data.

FIG. 15 illustrates different scanning order in two different patterns of image data.

A pattern of image data alternately having logical values of 1 and 0 in vertical and horizontal directions is illustrated in (a) of FIG. 15. A pattern of image data alternately having logical values of 1 and 0 in a horizontal direction is illustrated in (b) of FIG. 15. Further, the pattern of the image data illustrated in (b) of FIG. 15 has an equal logical value in a vertical direction.

In a case of the pattern of the image data illustrated in (a) of FIG. 15, the scan electrodes Y1, Y2, Y3, Y4, Y5, Y6 and Y7 are scanned in order of the scan electrodes Y1, Y3, Y5, Y7, Y2, Y4 and Y6. In a case of the pattern of the image data illustrated in (b) of FIG. 15, the scan electrodes Y1, Y2, Y3, Y4, Y5, Y6 and Y7 are scanned in order of the scan electrodes Y1, Y2, Y3, Y4, Y5, Y6 and Y7. In other words, scanning order is different in two different patterns of image data (i.e., as illustrated in (a) and (b) of FIG. 15).

Figure 16:
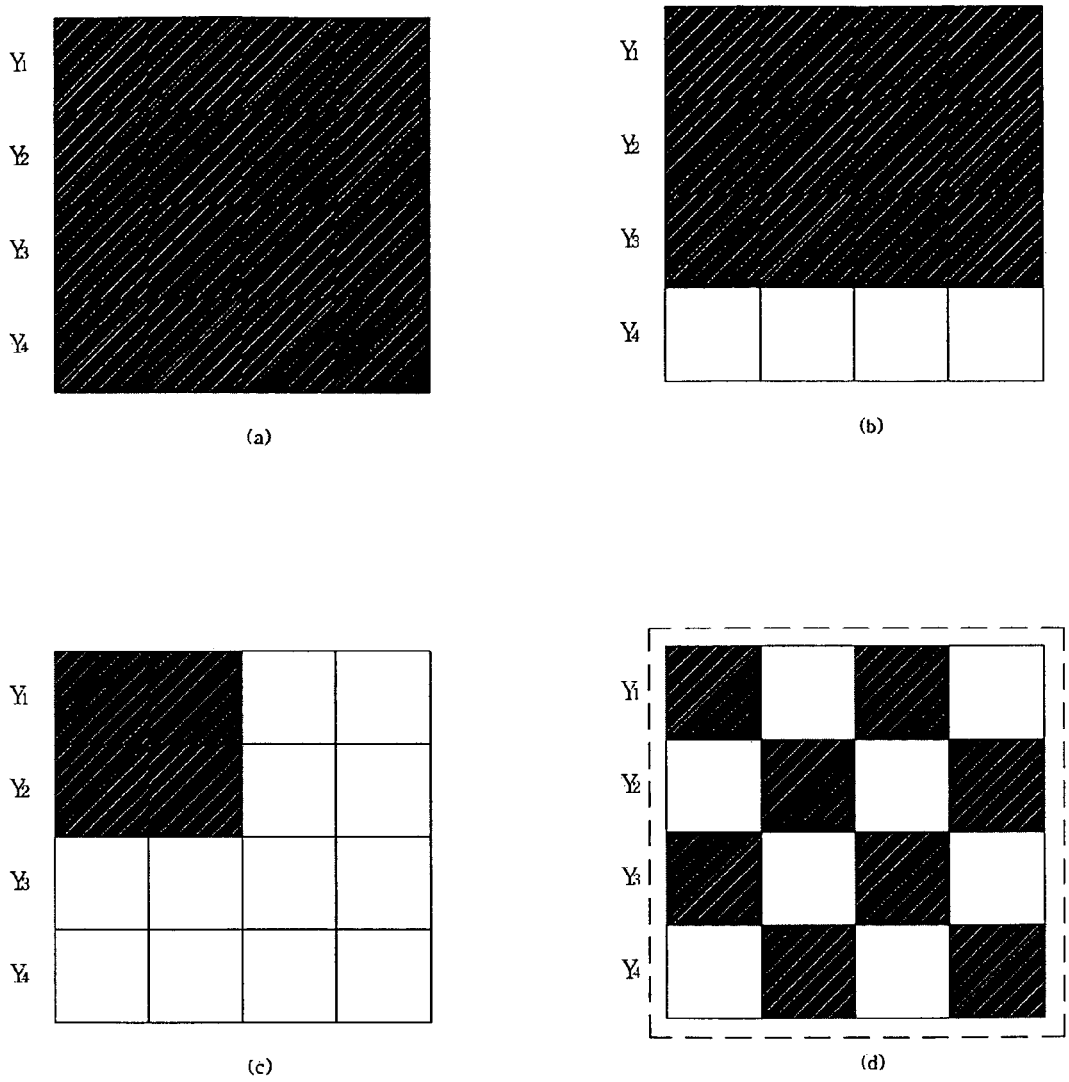
FIG. 16 illustrates an example of a method for adjusting scanning order by determining a critical value depending on a pattern of image data.

FIG. 16 illustrates an example of a method for adjusting scanning order by determining a critical value depending on a pattern of image data.

A case where all logical values of image data is equal to 1, is illustrated in (a) of FIG. 16. A case where all logical values of image data input to the scan electrode lines Y1, Y2 and Y3 is equal to 1 and all logical values of image data input to the scan electrode line Y4 is equal to 0, is illustrated in (b) of FIG. 16. A case where a logical value of image data input to first and second portions of the scan electrode lines Y1 and Y2 is equal to 1, a logical value of image data input to third and fourth portions of the scan electrode lines Y1 and Y2 is equal to 0, and all logical values of image data input to the scan electrode lines Y3 and Y4 is equal to 1, is illustrated in (c) of FIG. 16. A case where image data alternately having logical values of 1 and 0 is input to the scan electrode, is illustrated in (d) of FIG. 16.

In (a) of FIG. 16, the data driver IC does not perform the switching operation, and thus the total number of switching operation times of the data driver IC is equal to 0. In (b) of FIG. 16, the data driver IC performs the switching operation four times in the vertical direction. In (c) of FIG. 16, the data driver IC performs the switching operation two times in the vertical direction and two times in the horizontal direction. In (d) of FIG. 16, the data driver IC performs the switching operation twelve times in the vertical direction and twelve times in the horizontal direction. In other words, the data load is maximum in the pattern of the image data illustrated in (d) of FIG. 16.

The data load of the above data pattern, as described above, is calculated by a sum of data load of the data pattern in the vertical direction and data load of the data pattern in the horizontal direction.

For example, suppose that critical data load is set to a sum of data load according to 10 switching operations in the vertical direction and data load according to 10 switching operations in the horizontal direction. As a result, in (a), (b), (c) and (d) of FIG. 16, the image pattern illustrated in (d) of FIG. 16 exceeds the critical data load.

When the image data illustrated in (d) of FIG. 16 is input, the scanning order of the scan electrodes can be controlled. Since the scanning order of the scan electrodes was described above, a description thereof is omitted.

FIG. 17 illustrates an example of a method for determining scanning order in accordance with scan electrode groups including a plurality of scan electrodes.

As illustrated in FIG. 17, for example, a first scan electrode group includes scan electrodes Y1, Y2 and Y3, a second scan electrode group includes scan electrodes Y4, Y5 and Y6, a third scan electrode group includes scan electrodes Y7, Y8 and Y9, and a fourth scan electrode group includes scan electrodes Y10, Y11 and Y12. Each of the scan electrode groups includes three scan electrodes in FIG. 17, however, the number of scan electrodes of the scan electrode groups may be varied. For example, the scan electrode groups may include two, four, five scan electrodes.

Further, the number of scan electrodes of at least one of the plurality of scan electrode groups may be different from the number of scan electrodes of the remaining scan electrode groups.

When the scan electrodes of FIG. 17 are scanned in the second scanning type of FIG. 11, the scan electrodes of a first group are sequentially scanned and then the scan electrodes of a second group are sequentially scanned. In other words, the first and third scan electrode groups belonging to the first group are sequentially scanned, and then the second and fourth scan electrode groups belonging to the second group are sequentially scanned. The scan electrodes Y1 to Y12 are scanned in order of the scan electrodes Y1, Y2, Y3, Y7, Y8, Y9, Y4, Y5, Y6, Y10, Y11 and Y12.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

a plurality of scan electrodes;

a plurality of data electrodes intersecting with the plurality of scan electrodes;

a scan driver for scanning the plurality of scan electrodes during an address period in one scanning type of a plurality of scanning types having different scanning orders, and for supplying at least one scan signal, of which a duration of a voltage rising period is different from a duration of a voltage falling period, to the scan electrodes when scanning the scan electrodes, the at least one scan signal including a first scan signal and a second scan signal; and a data driver for supplying a data signal to the data electrodes depending on the scanning type selected from the plurality of scanning types, wherein:

the plurality of scan electrodes includes at least a first group of scan electrodes and a second group of scan electrodes, and the scan driver supplies the first scan signal to the first group of scan electrodes and supplies the second scan signal to the second group of scan electrodes, the first scan signal and the second scan signal having substantially a same period, and the first scan signal and the second scan signal have at least one of a different duration of a voltage rising period or a different duration of a voltage falling period.

2. The plasma display apparatus of claim 1, wherein the scanning type depends on a number of switching operation times of the data driver or a data load.

3. The plasma display apparatus of claim 2, wherein the selected scanning type is a scanning type which corresponds to a minimum number of switching operation times of the data driver or a minimum data load.

4. The plasma display apparatus of claim 2, wherein the scanning type comprises a first scanning type for scanning the scan electrodes divided into a plurality scan electrode groups, and when the first scanning type is a scanning type in which there is a minimum number of switching operation times of the data driver or there is a minimum data load, the scan driver successively scanning the scan electrodes of a same scan electrode group.

5. The plasma display apparatus of claim 1, wherein the duration of the voltage rising period of at least one of the first or second scan signal is more than the duration of the voltage falling period of said at least one of the first or second scan signal.

6. The plasma display apparatus of claim 1, wherein the data driver supplies the data signal in which a duration of a voltage falling period is different from a duration of a voltage rising period, to the data electrodes.

7. The plasma display apparatus of claim 6, wherein the duration of the voltage falling period of the data signal is more than the duration of the voltage rising period of the data signal.

8. The plasma display apparatus of claim 1, wherein when the plurality of data electrodes are divided into a plurality of data electrode groups each including one or more data electrodes, the data driver supplies the data signal to at least one of the plurality of data electrode groups, and supplies another data signal, of a voltage rising period or a voltage falling period with the duration different from the duration of a voltage rising period or a voltage falling period of the data signal, to one or more remaining data electrode groups.

9. The plasma display apparatus of claim 8, wherein the duration of the voltage rising period of the data signal supplied to each of the data electrodes of the same data electrode group is substantially equal to one another, and the duration of the voltage falling period of the data signal supplied to each of the data electrodes of the same data electrode group is substantially equal to one another.

10. The plasma display apparatus of claim 1, wherein the voltage rising period of at least one of the first or second scan signals supplied by the scan driver does not overlap the voltage falling period of the data signal supplied by the data driver.

11. The plasma display apparatus of claim 1, wherein the duration of the voltage rising period and the duration of the voltage falling period of at least one of the first or second scan signals in at least one subfield of subfields of a frame are different from the duration of the voltage rising period and the duration of the voltage falling period of said at least one of the first or second scan signals in the remaining subfields.

12. The plasma display apparatus of claim 11, wherein the duration of the voltage rising period of at least one of the first or second scan signal in a first subfield is less than the duration of the voltage rising period of said at least one of the first or second scan signal in a previous one or more subfields, and wherein the duration of the voltage falling period of at least one of the first or second scan signal in the first or a second subfield is more than the duration of the voltage falling period of said at least one of the first or second scan signal in one or more subfields previous to the first or said second subfield, the first and second subfields included within a same frame.

13. A plasma display apparatus comprising:

a plurality of scan electrodes;

a plurality of data electrodes intersecting with the plurality of scan electrodes;

a scan driver for scanning the plurality of scan electrodes during an address period in one scanning type of a plurality of scanning types having different scanning orders, and for supplying at least one scan signal to the scan electrodes when scanning the scan electrodes, at least one of a voltage rising period or a voltage falling period of the at least one scan signal being equal to or more than 50 ns, the at least one scan signal including a first scan signal and a second scan signal; and a data driver for supplying a data signal to the data electrodes depending on the scanning type selected from the plurality of scanning types, wherein:

the plurality of scan electrodes includes at least a first group of scan electrodes and a second group of scan electrodes, and the scan driver supplies the first scan signal to the first group of scan electrodes and supplies the second scan signal to the second group of scan electrodes, the first scan signal and the second scan signal having substantially a same period, and the first scan signal and the second scan signal have at least one of a different duration of a voltage rising period or a different duration of a voltage falling period.

14. The plasma display apparatus of claim 13, wherein the data driver supplies the data signal with a voltage falling period of 50 ns or more.

15. The plasma display apparatus of claim 13, wherein the scanning type depends on a number of switching operation times of the data driver or a data load.

16. The plasma display apparatus of claim 15, wherein the selected scanning type corresponds to a minimum number of switching operation times of the data driver or a minimum data load.

17. The plasma display apparatus of claim 13, wherein the duration of the voltage falling period of at least one of the first or second scan signal is more than the duration of the voltage falling period of said at least one of the first or second scan signal.

18. A method of driving a plasma display apparatus comprising a plurality of scan electrodes and a plurality of data electrodes intersecting with the plurality of scan electrodes, comprising:

scanning the plurality of scan electrodes during an address period in one scanning type of a plurality of scanning types having different scanning orders, and supplying at least one scan signal, of which a duration of a voltage rising period is different from a duration of a voltage falling period, to the plurality of scan electrodes when scanning the scan electrode, the at least one scan signal including a first scan signal and a second scan signal; and supplying a data signal to the plurality of data electrode depending on the scanning type selected from the plurality of scanning types, wherein:

the plurality of scan electrodes includes at least a first group of scan electrodes and a second group of scan electrodes, and said scanning includes supplying the first scan signal to the first group of scan electrodes and supplies the second scan signal to the second group of scan electrodes, the first scan signal and the second scan signal having substantially a same period, and the first scan signal and the second scan signal have at least one of a different duration of a voltage rising period or a different duration of a voltage falling period.

19. The method of claim 18, wherein the selected scanning type corresponds to a minimum number of switching operation times of the data driver or a minimum data load.

20. The method of claim 18, wherein the duration of the voltage rising period of at least one of the first or second scan signal in a first subfield is less than the duration of the voltage rising period of said at least one of the first or second scan signal in a previous one or more subfields, and wherein the duration of the voltage falling period of at least one of the first or second scan signal in the first or a second subfield is more than the duration of the voltage falling period of said at least one of the first or second scan signal in one or more subfields previous to the first or said second subfield, the first and second subfields included in a same frame.

21. The plasma display panel of claim 1, wherein the first and second groups have different numbers of scan electrodes.

22. The plasma display panel of claim 1, wherein the data signal and at least one of the first or second scan signal overlap during an address period.

23. The plasma display panel of claim 22, wherein the data signal and at least one of the first or second scan signal have substantially a same period and at least one of a different duration of a voltage rising period or a voltage falling period.

24. The plasma display panel of claim 23, wherein at least one of the voltage rising periods or voltage falling periods of the data signal and at least one of the first or second scan signal do not overlap.

25. The plasma display panel of claim 1, wherein the scan driver applies different scanning types to the plurality of electrodes in different sub-fields of a same frame.

26. The plasma display panel of claim 1, wherein the selected scanning type corresponds to scanning the plurality of scan electrodes in a predetermined non-sequential order, the predetermined non-sequential order causing image data having a same first logical value to be grouped together in a first pattern and image data having a same second logical value to be grouped together in a second pattern after the group of image data having the first logical value.

27. The plasma display panel of claim 26, wherein the pattern of image data having the first logical value is substantially equal to the pattern of image data having the second logical value.

* * * * *